US009538798B2

(12) United States Patent
Toronjo

(10) Patent No.: US 9,538,798 B2
(45) Date of Patent: Jan. 10, 2017

(54) ARTICLES OF APPAREL INCLUDING AUXETIC MATERIALS

(71) Applicant: Under Armour, Inc., Baltimore, MD (US)

(72) Inventor: Alan Toronjo, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 378 days.

(21) Appl. No.: 14/137,038

(22) Filed: Dec. 20, 2013

(65) Prior Publication Data

US 2014/0101816 A1 Apr. 17, 2014

Related U.S. Application Data

(63) Continuation-in-part of application No. 13/838,827, filed on Mar. 15, 2013.
(Continued)

(51) Int. Cl.
*A43C 11/00* (2006.01)
*A41D 31/00* (2006.01)
(Continued)

(52) U.S. Cl.
CPC ..... *A41D 31/0011* (2013.01); *A41D 31/02* (2013.01); *A42B 1/22* (2013.01); *A43B 23/027* (2013.01); *A43B 23/0215* (2013.01); *A45F 3/12* (2013.01); *A41D 13/0015* (2013.01); *A41D 31/0044* (2013.01); *A41D 2400/82* (2013.01); *A45F 3/04* (2013.01); *A45F 2003/001* (2013.01)

(58) Field of Classification Search
CPC ..... A41D 31/0011
See application file for complete search history.

(56) References Cited

U.S. PATENT DOCUMENTS 4,668,557 A 5/1987 Lakes
4,809,690 A 3/1989 Bouyssi
(Continued)

FOREIGN PATENT DOCUMENTS

FR 2876879 4/2006
JP 10072719 A 3/1998
(Continued)

OTHER PUBLICATIONS

European Search Report from EU Application No. 13179068, issued Nov. 20, 2013.

*Primary Examiner* — William P Watkins, III
(74) *Attorney, Agent, or Firm* — Maginot, Moore & Beck LLP

(57) ABSTRACT

An article of apparel includes at least one panel including a first edge and an opposing second edge. The at least one panel includes an auxetic structure defining a primary elongation direction and a secondary elongation direction. A plurality of lace coupling pairs are positioned along the first edge and the second edge of the at least one panel. Each lace coupling pair defines a lace pull direction that is perpendicular to a line extending through two adjacent lace couplings of the lace coupling pair. Each lace pull direction is defined by the plurality of lace couplings substantially in alignment with either the primary elongation direction or the secondary elongation direction of the auxetic structure between the two adjacent lace couplings of the lace coupling pair.

24 Claims, 21 Drawing Sheets

Related U.S. Application Data

(60) Provisional application No. 61/695,993, filed on Aug. 31, 2012.

(51) Int. Cl.

| | |
|---|---|
| ***A42B 1/22*** | (2006.01) |
| ***A43B 23/02*** | (2006.01) |
| ***A45F 3/12*** | (2006.01) |
| ***A41D 31/02*** | (2006.01) |
| *A41D 13/00* | (2006.01) |
| *A45F 3/04* | (2006.01) |
| *A45F 3/00* | (2006.01) |

(56) References Cited

U.S. PATENT DOCUMENTS

| | | | | |
|---|---|---|---|---|
| 5,334,903 | A | 8/1994 | Smith | |
| 5,661,854 | A | 9/1997 | March | |
| 5,937,441 | A | 8/1999 | Raines | |
| 6,029,376 | A * | 2/2000 | Cass | A43C 1/04 36/50.1 |
| 6,247,181 | B1 | 6/2001 | Hirsch | |
| 6,539,556 | B1 | 4/2003 | Barker | |
| 6,783,814 | B2 | 8/2004 | Swager | |
| 6,878,320 | B1 | 4/2005 | Alderson | |
| 6,989,075 | B1 | 1/2006 | Kao | |
| D521,191 | S | 5/2006 | Berger | |
| 7,160,621 | B2 | 1/2007 | Chaudhari | |
| 7,247,265 | B2 | 7/2007 | Alderson | |
| 7,252,870 | B2 | 8/2007 | Anderson | |
| 7,350,851 | B2 | 4/2008 | Barvosa-Carter | |
| 7,455,567 | B2 | 11/2008 | Bentham et al. | |
| 7,650,648 | B2 | 1/2010 | Roberts | |
| 7,824,763 | B2 | 11/2010 | Namburi | |
| 7,858,055 | B2 | 12/2010 | Lee | |
| 7,896,294 | B2 | 3/2011 | Dittrich | |
| 7,910,193 | B2 | 3/2011 | Ma | |
| 7,989,057 | B2 | 8/2011 | Alderson | |
| 8,074,418 | B2 | 12/2011 | Thiagarajan | |
| 8,084,117 | B2 | 12/2011 | Lalvani | |
| 8,304,355 | B2 | 11/2012 | Baldauf | |
| 8,436,508 | B2 | 5/2013 | Kornbluh | |
| 2002/0132543 | A1 | 9/2002 | Baer | |
| 2005/0035031 | A1 | 2/2005 | Alderson | |
| 2005/0159066 | A1 | 7/2005 | Alderson et al. | |
| 2006/0129227 | A1 | 6/2006 | Hengelmolen | |
| 2007/0031667 | A1 | 2/2007 | Hook | |
| 2007/0093768 | A1 | 4/2007 | Roe | |
| 2007/0213838 | A1 | 9/2007 | Hengelmolen | |
| 2007/0286987 | A1 | 12/2007 | Anderson | |
| 2008/0011021 | A1 | 1/2008 | Starbuck | |
| 2008/0032598 | A1 | 2/2008 | Bentham et al. | |
| 2008/0248710 | A1 | 10/2008 | Wittner | |
| 2009/0041978 | A1 | 2/2009 | Sogard | |
| 2009/0119820 | A1 | 5/2009 | Bentham | |
| 2009/0239049 | A1 | 9/2009 | Hook | |
| 2009/0265839 | A1 | 10/2009 | Young | |
| 2010/0029796 | A1 | 2/2010 | Alderson | |
| 2010/0107317 | A1 | 5/2010 | Wang | |
| 2010/0305535 | A1 | 12/2010 | Leeming | |
| 2010/0306904 | A1 | 12/2010 | Neid | |
| 2011/0029063 | A1 | 2/2011 | Ma | |
| 2011/0039088 | A1 | 2/2011 | Lee | |
| 2011/0046715 | A1 | 2/2011 | Ugbolue | |
| 2011/0059291 | A1 | 3/2011 | Boyce | |
| 2011/0144417 | A1 | 6/2011 | Jagger | |
| 2011/0155137 | A1 | 6/2011 | Martin | |
| 2011/0156314 | A1 | 6/2011 | Alberg | |
| 2011/0159758 | A1 | 6/2011 | Martin | |
| 2011/0168313 | A1 | 7/2011 | Ma et al. | |
| 2011/0209557 | A1 | 9/2011 | Burns | |
| 2011/0214560 | A1 | 9/2011 | Skertchly | |
| 2011/0236519 | A1 | 9/2011 | Skertchly | |
| 2011/0250383 | A1 | 10/2011 | Summers | |
| 2011/0252544 | A1 | 10/2011 | Abernethy | |
| 2011/0265714 | A1 | 11/2011 | Lee | |
| 2011/0281481 | A1 | 11/2011 | Alderson | |
| 2011/0282452 | A1 | 11/2011 | Koerner | |
| 2012/0029537 | A1 | 2/2012 | Mortarino | |
| 2012/0055187 | A1 | 3/2012 | Raines | |
| 2012/0060991 | A1 | 3/2012 | Mun | |
| 2012/0066820 | A1 | 3/2012 | Fresco | |
| 2012/0129416 | A1 | 5/2012 | Anand | |
| 2013/0071583 | A1 | 3/2013 | Evans | |
| 2013/0134992 | A1 | 5/2013 | Zhu | |

FOREIGN PATENT DOCUMENTS

| | | |
|---|---|---|
| JP | 2007138320 A | 6/2007 |
| WO | 2010082537 S1 | 7/2010 |
| WO | 2012069787 | 5/2012 |

* cited by examiner

ARTICLES OF APPAREL INCLUDING AUXETIC MATERIALS

CROSS-REFERENCE TO RELATED APPLICATIONS

This application is a continuation-in-part of U.S. application Ser. No. 13/838,827, filed Mar. 15, 2013, which claims priority from U.S. Provisional Patent Application No. 61/695,993, filed Aug. 31, 2012. The disclosure of each of the aforementioned applications is incorporated herein by reference in its entirety.

FIELD

This document relates to the field of apparel, and particularly to garments, footwear, padding, bags or other products configured to be worn or carried on the body.

BACKGROUND

Many garments and other articles of apparel are designed to fit closely to the human body. When designing an article of apparel for a close fit to the human body, different body shapes and sizes must be considered. Different individuals within a particular garment size will have different body shapes and sizes. For example, two individuals wearing the same shoe size may have very differently shaped heels. As another example, two individuals wearing the same shirt size may have very different chest to abdomen dimensions. These variable measurements between similarly sized individuals makes proper design of closely fitting garments difficult.

In addition to accounting for different body measurements for different individuals within a size, various contours of the human body must also be considered when designing closely fitting articles of apparel. These contours of the human body often include various double curvature surfaces. Spheroids, bowls, and saddle-backs are all examples of surfaces having double curvatures. If a garment is not properly sized for a particular wearer, the wearer may experience undesirable tightness or looseness at various locations. Such an improper fit may result in discomfort, excessive wear, buckling, bending or creasing of the garment at the poorly fitting locations.

The contour and fit of a particular of apparel may be further complicated by fastening arrangements such as zippers, buttons and lacing arrangements which draw opposing seams toward one another and couple them together. In particular, because fastening arrangements draw two opposing sides together, there is often buckling and creasing in the area of the fastening arrangement when the sides are drawn together, and this can lead to discomfort and undesirable tightness to the wearer.

In view of the foregoing, it would be desirable to provide a garment or other article of apparel capable of conforming to various body shapes within a given size range. It would also be desirable to provide a garment or other article of apparel that is capable of conforming to various double curvatures on the human body. Furthermore, it would be advantageous for such an article to include a fastening arrangement adapted to reduce buckling and discomfort to a wearer when the fastening arrangement is drawn together. In addition, it would be desirable for such a garment or article of apparel to be relatively inexpensive and easy to manufacture.

SUMMARY

In accordance with one exemplary embodiment of the disclosure, there is provided an article of apparel comprising at least one panel including a first edge and an opposing second edge. The at least one panel includes an auxetic structure defining a primary elongation direction and a secondary elongation direction. A plurality of lace couplings are positioned along the first edge and the second edge of the at least one panel. The plurality of lace couplings include a plurality of lace coupling pairs, each lace coupling pair including two adjacent lace couplings both positioned along either the first edge or the second edge of the at least one panel. Each lace coupling pair defines a lace pull direction that is perpendicular to a line extending through the two adjacent lace couplings of the lace coupling pair. Each lace pull direction is defined by the plurality of lace couplings substantially in alignment with either the primary elongation direction or the secondary elongation direction of the auxetic structure between the two adjacent lace couplings of the lace coupling pair.

Pursuant to another exemplary embodiment of the disclosure, there is provided a footwear article including a sole and an upper coupled to the sole. The upper includes a forefoot region, a midfoot region, and a heel region. The upper further includes a tongue opening defined between a medial edge and an opposing lateral edge in the midfoot region of the upper. An integrally formed auxetic structure is provided on a panel of the upper and extends from the forefoot region to the heel region. A plurality of lace couplings are provided on the panel of the upper and extend along the medial edge and the lateral edge of the tongue opening.

In accordance with yet another exemplary embodiment of the disclosure, there is provided a footwear article comprising a sole and an upper connected to the sole. The upper includes a forefoot region, a midfoot region, and a heel region, the upper includes at least one panel provided in the midfoot region, the at least one panel includes a base layer connected to an auxetic layer. The base layer comprises a fabric stretch material and the auxetic layer comprising an auxetic structure defining a repeating pattern of voids.

The above described features and advantages, as well as others, will become more readily apparent to those of ordinary skill in the art by reference to the following detailed description and accompanying drawings. While it would be desirable to provide an article of apparel that provides one or more of these or other advantageous features, the teachings disclosed herein extend to those embodiments which fall within the scope of the appended claims, regardless of whether they accomplish one or more of the above-mentioned advantages.

DESCRIPTION

As described herein, an article of apparel includes a base layer and an auxetic layer coupled to the base layer. The term "article of apparel" as used herein refers to any garment, footwear or accessory configured to be worn on or carried by a human. Examples of articles of apparel include helmets, hats, caps, shirts, pants, shorts, sleeves, knee pads, elbow pads, shoes, boots, backpacks, duffel bags, cinch sacks, and straps, as well as numerous other products configured to be worn on or carried by a person.

The term "auxetic" as used herein generally refers to a material or structure possessing a negative Poisson's ratio. In other words, when stretched, auxetic materials become thicker (as opposed to thinner) or expand in a direction perpendicular to the applied force. This occurs due to inherent hinge-like structures within the materials which flex when stretched. In contrast, materials with a positive Poisson's ratio contract in a direction perpendicular to the applied force.

Exemplary Auxetic Structures

Figure 1A:
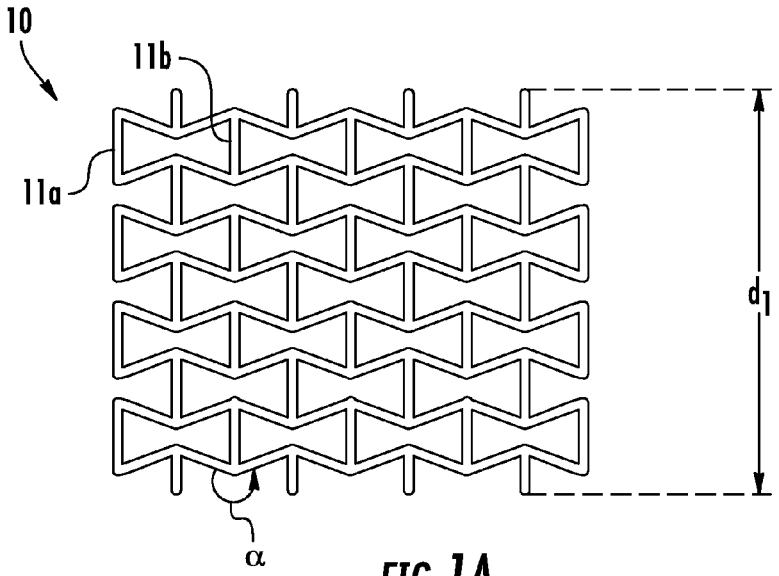
FIG. 1A shows a plan view of an auxetic structure including segments and voids forming a plurality of reentrant shapes.
Figure 1B:
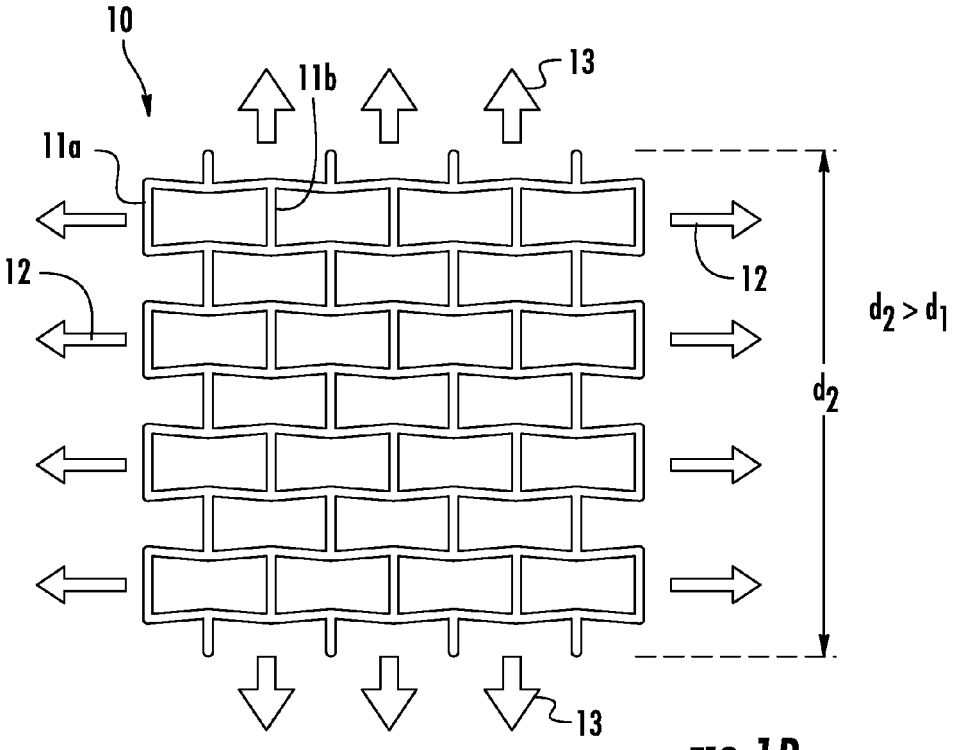
FIG. 1B shows a plan view of the auxetic structure of FIG. 1A in an expanded position.

One exemplary auxetic structure 10 is shown in FIGS. 1A and 1B. The auxetic structure 10 is provided by a plurality of generally-polygon-shaped cells (e.g., hourglass or bow-tie shaped cells, which may also be referred to as "auxetic hexagons"). The cells are oriented in an array, being positioned in horizontal rows and vertical columns. FIG. 1A shows the auxetic structure 10 in its normal, unstretched state. The thickness (or width) of the auxetic structure in the unstretched state is indicated as d1. FIG. 1B shows the auxetic structure 10 stretched in the direction of arrows 12. The thickness of the auxetic structure in the stretched state is indicated by d2. As can be seen in FIG. 1B, when tension is applied along a first direction (indicated by arrows 12), the auxetic structure is stretched, expanding (becoming thicker) in a second direction perpendicular to the first direction 12 (indicated by arrows 13) such that, in the stretched state d2>d1. This is the result of the pivoting/rotation that occurs along the vertices of the shape, i.e., where the corners of the polygon intersect.

It will be recognized that whether a structure has a negative Poisson's ratio, may depend upon the degree to which the structure is stretched. Structures may have a negative Poisson's ratio up to a certain stretch threshold, but when stretched past the threshold may have a positive Poisson's ratio. For example, it is possible that when the auxetic structure 10 in FIG. 1A is stretched in the direction of arrows 12 past a threshold expansion position (e.g., past the state shown in FIG. 1B), the cells and segments of the auxetic structure 10 may be stretched to an extent that the auxetic structure 10 becomes slightly thinner (in the direction perpendicular to arrows 12) before the structure is torn apart or otherwise damaged. Accordingly, the term "auxetic" as used herein refers to structures or materials that possess or exhibit a negative (below zero) Poisson's ratio at some point during stretch. Preferably, the structure or material possesses a negative Poisson's ratio during the entirety of the stretch. The term "near auxetic," moreover, is used herein to refer to a structure having a Poisson's ratio of approximately zero and, in particular, less than +0.15.

Auxetic structures are formed from a plurality of interconnected segments forming an array of cells, and each cell having a reentrant shape. In the field of geometry, a reentrant shape may also be referred to as a "concave", or "non-convex" polygon or shape, which is a shape having an interior angle with a measure that is greater than 180°. The auxetic structure 10 in FIGS. 1A and 1B is an example of such a structure including a reentrant shape. As shown, angle $\alpha$ possesses a measurement of greater than 180°.

Auxetic structures may be defined by two different elongation directions, namely, a primary elongation direction and a secondary elongation direction. The primary elongation direction is a first direction along which the cells of the auxetic structure are generally arranged, and the secondary elongation direction is the direction perpendicular to the first direction, the cells of the auxetic structure also being arranged along this second direction. For example, in FIGS. 1A and 1B, the horizontal arrows 12 (from the viewpoint of FIG. 1B define the primary elongation direction, while vertical arrows 13 (from the viewpoint of FIG. 1B) define the secondary elongation direction. When a tension force elongates the auxetic structure 10 in the primary elongation direction, the auxetic structure is also elongated in the secondary elongation direction. Similarly, applying tension to the auxetic structure 10 in the secondary elongation direction causes elongation in the primary elongation direction.

The total number of cells, the shape of each shell, and the overall arrangement of the cells within the structure generate the expansion pattern of the auxetic structure. That is, the arrangement and shape of the cells determine whether the auxetic structure 10 expands a greater amount in the primary elongation direction or the secondary elongation direction.

It is worth noting that the phrases "primary elongation direction" and "secondary elongation direction" as used herein do not necessarily indicate that the auxetic structure 10 elongates further in one direction or the other, but is merely used to indicate the two directions of elongation for the auxetic structure as defined by the cells, with one direction being perpendicular to the other. For auxetic structures having polygon shaped cells with two or more substantially parallel opposing edges (e.g., edges 11*a* and 11*b* in FIGS. 1A and 1B), the primary elongation direction may be considered to be a line that extends perpendicularly through the substantially parallel opposing edges (e.g., edges 11*a* and 11*b*) of the cells. Thus, in the auxetic structure of FIGS. 1A and 1B, the primary elongation direction is defined by arrows 12.

Auxetic Arrangements Including Auxetic Layer Disposed on Base Layer

In at least one embodiment, an auxetic arrangement 14 includes an auxetic structure 10 mounted on a flexible, resilient substrate. The auxetic structure 10 is an open framework capable of supporting the substrate and directing the substrate's expansion under a load. Accordingly, the auxetic structure, though flexible, may be more stiff than the substrate (i.e., the segments forming the auxetic structure 10 possess a higher elastic modulus than the substrate). The substrate, moreover, is generally more elastic than the auxetic structure in order to return the structure to its original state upon removal of the tensile strain.

Figure 2A:
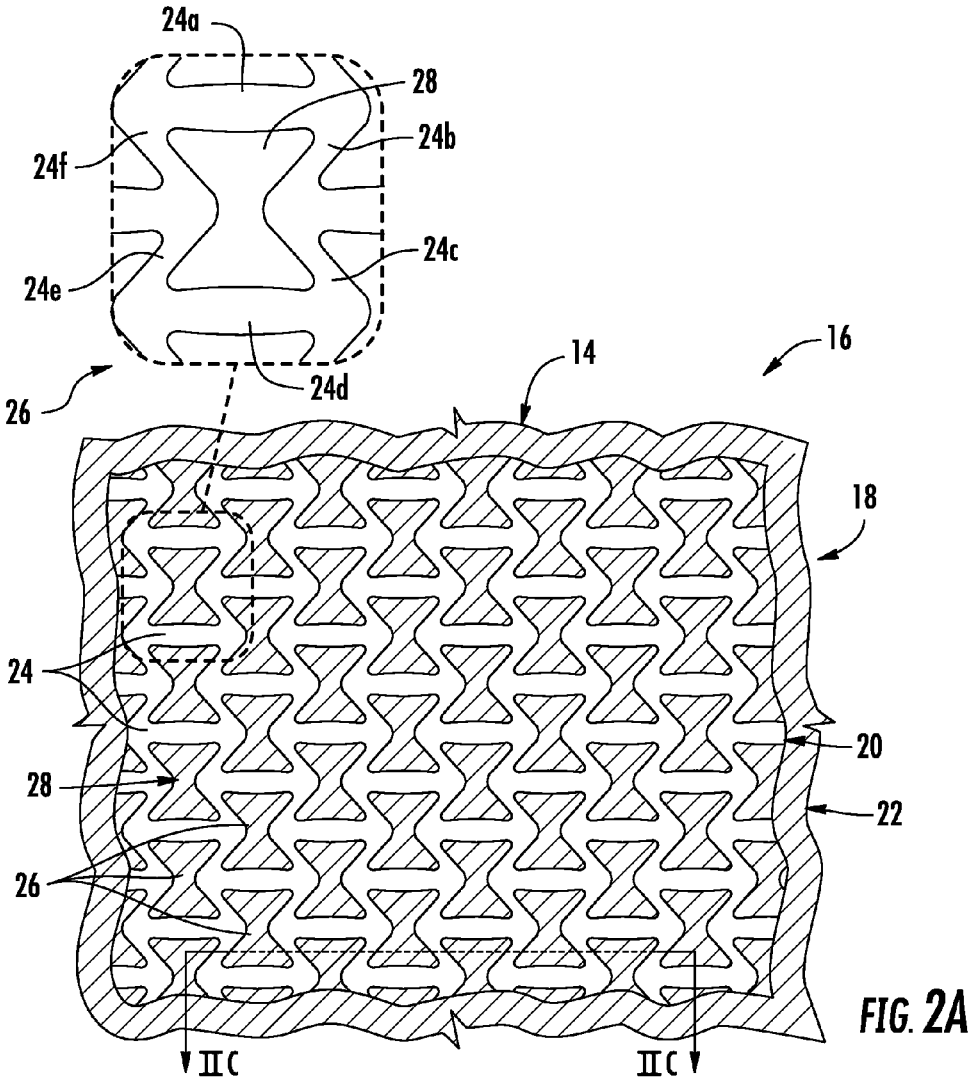
FIG. 2A shows a panel of an article of apparel including an auxetic arrangement with the auxetic structure of FIG. 1A.
Figure 2B:
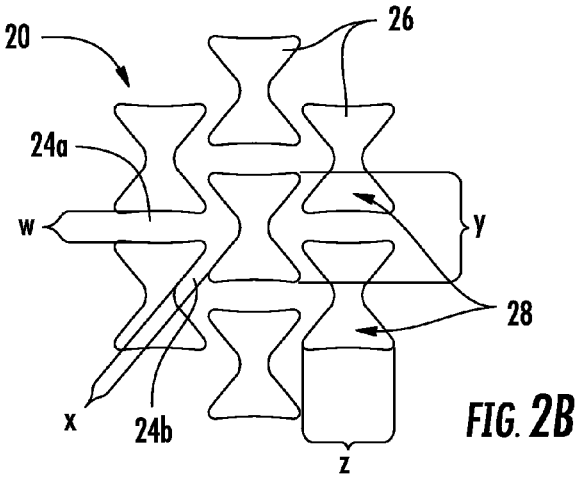
FIG. 2B shows an enlarged, schematic view of the auxetic arrangement of FIG. 2A, showing dimensions of the arrangement.

With reference now to FIGS. 2A and 2B, in at least one exemplary embodiment, an article of apparel 16 includes an auxetic arrangement 14 incorporated into at least one panel 18 or other portion with of the article of apparel. The auxetic arrangement 14 is comprised of a first or auxetic layer 20 coupled to a second or resilient layer 22 (the second layer 22 is shown under the first layer 20 in FIG. 2A). The second layer 22 may also be referred to as a "substrate layer" or a "base layer."

The auxetic layer 20 includes the auxetic structure 10. Specifically, the auxetic layer 20 (and thus, the auxetic structure 10) is a plurality of segments 24 arranged to provide a repeating pattern or array of cells 26, each cell possessing a reentrant shape. Specifically, each cell 26 is defined by a set of interconnected structural members 24*a*, 24*b*, 24*c*, 24*d*, 24*e*, 24*f*, with an aperture or void 28 formed in the center of the cell 26. The void 28 exposes the second layer 22 to which the first layer 20 is coupled. Accordingly, the auxetic layer 20 is a mesh framework defined by segments 24 and voids 28.

Figure 3A:
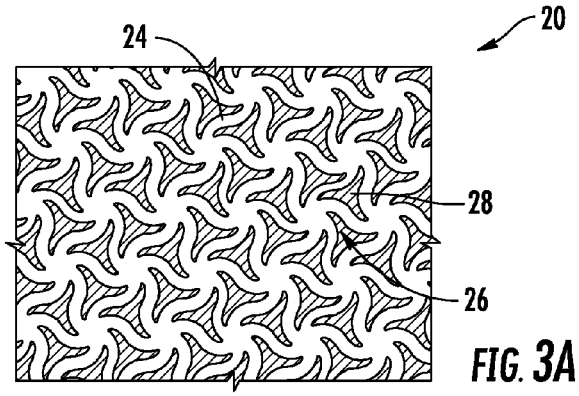
FIG. 3A shows a plan view of an alternative embodiment of the auxetic structure of FIG. 1A.
Figure 3B:
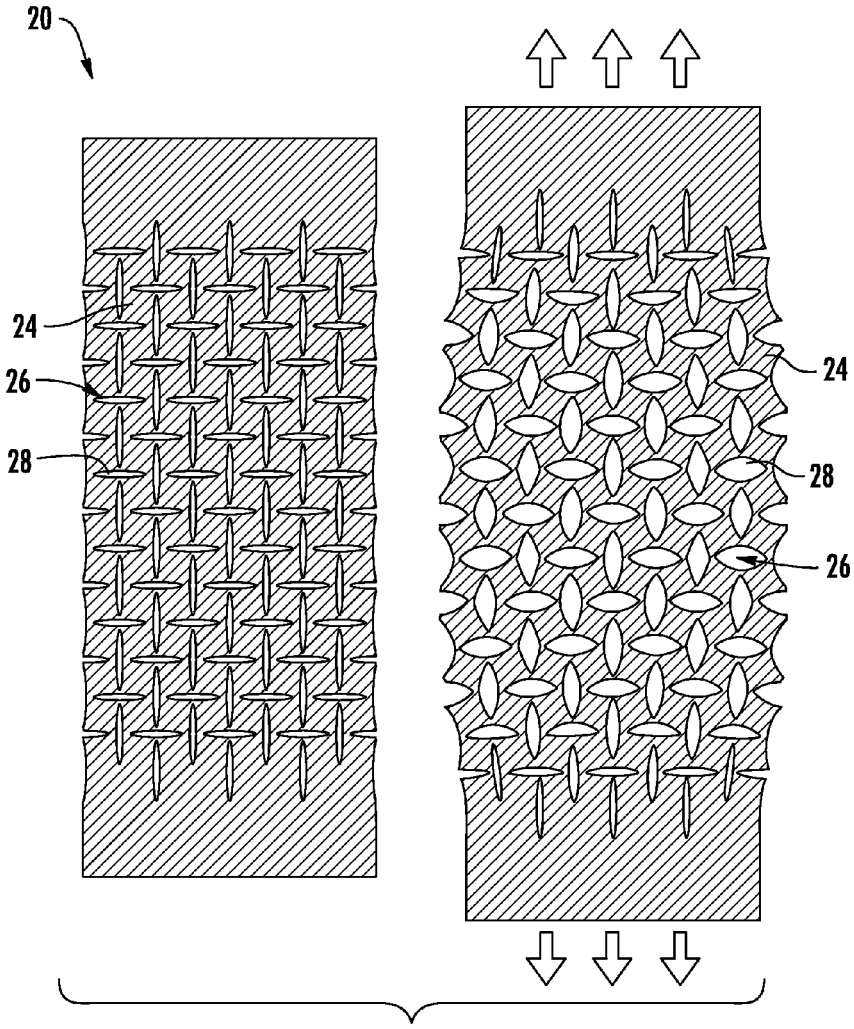
FIG. 3B shows a plan view of another alternative embodiment of the auxetic structure of FIGS. 3A and 3B.

In an embodiment, the auxetic layer 20 is unitary structure, with each cell 26 sharing segments 24 with adjacent cells. The cells 26 form an array of reentrant shapes, including a plurality of rows and columns of shapes defined by the voids 28. In the embodiment of FIG. 2A, the reentrant shapes are bow-tie shapes (or auxetic hexagon shapes, similar to the shapes shown in FIGS. 1A and 1B). However, it will be recognized by those of ordinary skill in the art that the cells 26 of the auxetic structure may include differently shaped segments or other structural members and differently shaped voids. FIGS. 3A-3B show two exemplary alternative auxetic structures. In FIG. 3A, the cells 26 of the auxetic layer 20 have a twisted triangular or triangular vortex shape, and the interconnected structural members are curved segments. In FIG. 3B, the cells 26 are oval shaped, and the interconnected structural members are rectangular or square structures.

In an embodiment, the segments 24 possess uniform dimensions. With reference again to the exemplary embodiment of FIGS. 2A and 2B, in an embodiment, the segments 24 forming the cells 26 (i.e., the cell structural members 24*a*-24*f*) are not necessarily uniform in shape and thickness. In particular, as shown in FIG. 2B, segment 24*a* is slightly bowed or convex along its length while segment 24*b* is substantially straight along its length. Segment 24*a* has a width, w, of between 1 mm and 5 mm, and particularly 3 mm. Segment 24*b* has a width, x, between 0.5 mm and 4 mm, and particularly 2 mm. While the segments 24 may vary somewhat in size and shape, the voids 28 are substantially uniform in size and shape. In the embodiment of FIG. 2B, the cell voids 28 have a height, y, between 6 and 12 mm, and particularly about 9.3 mm. The cell voids 28 have a width, z, between 6 and 12 mm, and particularly about 8.8 mm. Although not illustrated in FIG. 2B, the cross-sectional thickness of each segment 24 may be between 0.5 mm and 5 mm, and more specifically in some embodiments, between 1 mm and 2 mm, and particularly about 1.5 mm.

The auxetic layer 20 may be formed of any materials suitable for its described purpose. In an embodiment, the segments 24 are formed of any of various different resilient materials. In at least one exemplary embodiment, the segments 24 are comprised of a polymer such as ethylene-vinyl acetate (EVA), a thermoplastic such as nylon, or a thermoplastic elastomer such as polyurethane. Each of these materials possesses elastomeric qualities of softness and flexibility.

In another exemplary embodiment, the segments 24 are comprised of foam, such as a thermoplastic polyurethane (TPU) foam or an EVA foam, each of which is resilient and provides a cushioning effect when compressed. While EVA and TPU foam are disclosed herein as exemplary embodiments of the auxetic layer 20, it will be recognized by those of ordinary skill in the art that the auxetic layer 20 may alternatively be comprised of any of various other materials. For example, in other alternative embodiments, the auxetic layer may be comprised of polypropylene, polyethylene, XRD foam (e.g., the foam manufactured by the Rogers Corporation under the name PORON®), or any of various other polymer materials exhibiting sufficient flexibility and elastomeric qualities. In a further embodiment, the foam forming the auxetic layer is auxetic foam.

The segments 24 of the auxetic layer 20 may be formed in any of various methods. By way of example, the auxetic layer 20 is formed via a molding process such as compression molding or injection molding. By way of further example, the auxetic layer is formed via an additive manufacturing process such as selective laser sintering (SLS). In SLS, lasers (e.g., $CO_2$ lasers) fuse successive layers of powdered material to form a three dimensional structure. Once formed, the auxetic layer 20 coupled (e.g., attached or mounted) to the base layer 22. Specifically, the auxetic layer 20 may be connected to the base layer 22 using any of various connection methods (examples of which are described in further detail below).

In at least one embodiment, the auxetic layer 20 is printed directly on to the base layer 22 using any of various printing methods, as will be recognized by those of ordinary skill in the art. Alternatively, the auxetic layer 20 may first be printed on a transfer sheet, and then a heat transfer method may be used to transfer the auxetic layer to the base layer 22.

As mentioned above, in at least one exemplary embodiment, the void 28 of each cell 26 in the auxetic layer 20 exposes the second layer 22 through the auxetic layer. In an alternative embodiment, the void 28 is filled with material such as an elastic material (e.g., a hot melt or other thermoplastic material) that partially or substantially fills the void 28 at the interior portion of the cell between the outer walls (i.e., the segments 24). The elastic material differs from the material forming the segments 24 of the auxetic layer. Filling the void with elastic material increases the resiliency of the auxetic structure. In contrast, a void 28 without material results in a more expansive auxetic structure 10 (compared to a filled void).

The base layer 22 is a flexible, resilient layer operable to permit the expansion of the auxetic layer 20 when tension is applied to the arrangement 14. Typically, the base layer 22 is an inner layer facing and/or contacting the wearer of the apparel. In an embodiment, the base layer 22 comprises a resilient material having selected stretch capabilities, e.g., four-way or two-way stretch capabilities. A material with "four way" stretch capabilities stretches in a first direction and a second, directly-opposing direction, as well as in a third direction that is perpendicular to the first direction and a fourth direction that is directly opposite the third direction. In other words, a sheet of four-way stretch material stretches in both crosswise and lengthwise. A material with "two way" stretch capabilities, in contrast, stretches to some substantial degree in the first direction and the second, directly opposing direction, but will not stretch in the third and fourth directions, or will only stretch to some limited degree in the third and fourth directions relative to the first and second directions (i.e., the fabric will stretch substantially less in the third and fourth directions than in the first direction and second directions). In other words, a sheet of two-way stretch material stretches either crosswise or lengthwise.

By way of example, the base layer 22 is formed of a four-way stretch fabric such as elastane fabric or other compression material including elastomeric fibers. By way of further example, the base layer 22 is comprised of the compression material incorporated into garments and accessories sold by Under Armour, Inc. under the trademarks HEATGEAR or COLDGEAR. In other embodiments, the base layer 22 is comprised of an elastic fabric having limited stretch properties, such as a two-way stretch fabric.

Selection of the base layer 22 relative to the auxetic layer 20 permits the control of the base layer stretch pattern and/or the auxetic layer stretch pattern (discussed in greater detail below).

It should be understood that, while the base layer 22 has been described as being formed of a stretch fabric, in other embodiments, the base layer may be comprised of other resilient materials, including any of various elastomers such as thermoplastic polyurethane (TPU), nylon, or silicone (e.g., a plastic sheet formed of resilient plastic). Furthermore, when the base layer is comprised of an elastomer, the base layer 22 may be integrally formed with the auxetic layer 20 to provide a continuous sheet of material that is seamless and without constituent parts, with the generally solid base layer on one side of the material and the auxetic structure on the opposite side of the material.

The auxetic layer 20 is coupled (e.g., mounted, attached, or fixed) to the base layer 22. By way of example, the auxetic layer 20 is an elastomer sheet bonded or otherwise directly connected to a stretch fabric base layer 22 such that the two layers 20 and 22 function as a unitary structure. To this end, the auxetic layer 20 may be connected to the base layer 22 via adhesives, molding, welding, sintering, stitching or any of various other means. In an embodiment, the auxetic layer 20 is brought into contact with the base layer 22 and then heat is applied to place the material forming the auxetic layer in a semi-liquid (partially melted) state such that material of the auxetic layer in contact with the base layer infiltrates the base layer fabric. Alternatively, the auxetic layer is applied in a molten or semi-molten state. In either application, once cooled, the auxetic layer 20 is securely fixed (permanently connected) to the fibers of the base layer 22 such that any movement of the base layer is transferred to the auxetic layer, and vice versa.

This structure including the auxetic layer 20 and the base layer 22—has been found to provide improved contouring properties around a three-dimension object compared to a structure including only the base layer. For example, when incorporated into an article of apparel 16 (e.g., a compression garment), the apparel easily and smoothly conforms to the various shapes and curvatures present on the body. The auxetic arrangement 14 is capable of double curvature forming synclastic and/or anticlastic forms when stretched. Double curvatures are prevalent along the human form. Accordingly, the auxetic arrangement 14 will follow the curvatures of the body with little to no wrinkling or folding visible to the wearer. Without being bound to theory, it is believed that the auxetic layer 20 cooperates with the base layer 22 to expand along two axes while tightly conforming to the surface of the wearer (e.g., to the wearer's foot, arm, leg, head, etc.).

With various configurations of the auxetic arrangement, then, it is possible to control the overall stretch/expansion pattern of the auxetic arrangement 14 by combining the individual properties of the auxetic layer 20 and the base layer 22. By way of example, it is possible to provide a non-auxetic layer with auxetic properties. In an embodiment, the base layer 22 is four-way stretch material that, by itself, is not auxetic (i.e., it exhibits a positive Poisson's ratio under load). Accordingly, when the base layer is separated from the auxetic layer and tension is applied across the base layer material, the base layer material contracts in the direction perpendicular to the applied tension. Superimposing the auxetic layer 20 over the base layer 22, however, provides a framework sufficient to drive the expansion pattern of the base layer. As a result, the base layer 22 in the combined structure (i.e., in the arrangement 14) will now follow the expansion pattern of the auxetic structure 10, expanding not only along the axis of the applied tensile strain, but also along the axis perpendicular to the axis of the applied tensile strain. The resiliency of the base layer 22, moreover, optimizes the contouring ability of the entire arrangement 14 since it tightly conforms to the surface of the wearer. Furthermore, the base layer 22, being resilient, limits the expansion of the auxetic layer 20 to that necessary to conform to the object. That is, the base layer 22, while permitting expansion of the auxetic layer 20, will draw the layer back towards its normal/static position. Accordingly, over expansion of the auxetic layer 20 is avoided.

Additionally, it is possible to delimit the auxetic properties of the auxetic structure by selecting an appropriate base layer 22. When forming apparel 16 (e.g., footwear), while expansion is desired, it is often desirable to limit the degree of expansion along one or more axes. By selecting a base layer 22 of two-way stretch material, it is possible to limit the expansion along a selected axis. Specifically, mounting an auxetic layer 20 onto a base layer 22 formed of two-way stretch material permits the expansion of the auxetic arrangement 14 along an axis parallel to the two-way stretch direction of the base layer 22, but limits expansion of the arrangement along an axis perpendicular to the two-way stretch direction of the base layer 22. Accordingly, application of a tension along the two-way stretch direction of the base layer 22 results in significant expansion of the auxetic arrangement 14 along the two-way stretch direction, but only limited or no expansion of the auxetic arrangement along the axis perpendicular to the two-way stretch direction. Application of a tension along the axis perpendicular to the two way stretch direction results in limited or no expansion of the auxetic arrangement in either direction. In this manner, an article of apparel may possess a customized stretch direction, including a plurality of auxetic arrangements selected and position to provide optimum stretch properties to the apparel.

Thus, in embodiments where the base layer 22 has two-way or four-way stretch properties, the orientation of the base layer 22 relative to the auxetic layer 20 may have an effect on the overall stretch properties of the auxetic structure. For example, consider a panel 18 with a base layer 22 having two-way stretch properties configured such that the two way stretch direction of the base layer 22 is aligned with a stretch direction of the auxetic layer 20 (e.g., the two-way stretch direction of the base layer 22 is aligned with the arrows 12 shown on the auxetic structure 10 in the embodiment of FIG. 1B). The Poisson's ratio exhibited by this panel 18 may tend to be closer to zero, or "near zero", than would be exhibited by a panel 18 including a base layer 22 with four-way stretch properties. In particular, because the base layer 22 limits stretch in the perpendicular direction (e.g., in the direction of arrows 13 in FIG. 1B), the stretch of the panel 18 will be limited in this perpendicular direction, thus keeping the Poisson's ratio for the panel closer to zero.

Finally, the combined structure including the auxetic layer 20 attached to the base layer 22 forms a more supportive structure than either layer alone. That is, the auxetic layer 20 described above provides an open framework that functions as a support structure for the article of apparel 16. For example, when used to form an upper in an article of footwear, the combined structure may be generally self-supporting. In other embodiments, the auxetic arrangement 14 possesses greater structure than the base layer 22 alone.

Examples of Additional Auxetic Arrangements

Figure 2C:
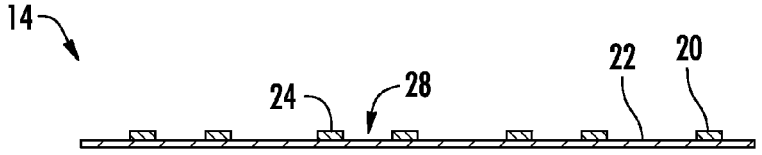
FIG. 2C shows a cross-sectional view of an exemplary embodiment of the auxetic arrangement of FIG. 2A.
Figure 2D:
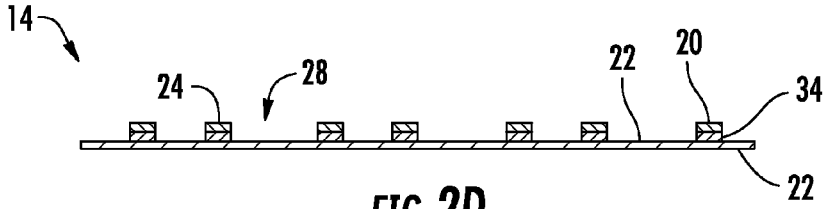
FIG. 2D shows a cross-sectional view of an exemplary embodiment of the auxetic arrangement of FIG. 2A further including a foam sublayer.

FIG. 2D shows a cross-sectional view of the auxetic layer 20 and base layer 22 according to another exemplary embodiment. In FIG. 2D, a foam layer 34 is provided between and couples the auxetic layer 20 to the base layer 22. The auxetic layer 20 and the base layer 22 may be coupled to the foam layer 34 using any of various means, including adhesives, molding, welding, sintering or any of various other means as will be recognized by those of ordinary skill in the art. The foam layer 34 is substantially the same shape and size as the auxetic layer 20, defining segments and voids in registry with the segments 24 and voids 28 of the auxetic layer 20. The foam layer 34 may be comprised of any of various types of foam, such as a TPU foam, EVA foam, XRD foam (such as PORON® foam manufactured by Rogers Corporation). However, it will be recognized that the foam may be comprised of any of various materials, including other foam polymers. Because the foam layer 34 has the same structure as the auxetic layer 20, the foam layer 34 is configured to expand and contract with the auxetic layer, and does not provide substantial resistance to such expansion and contraction of the auxetic layer 20. However, the soft foam provides additional padding to the arrangement, with additional impact forces to the auxetic layer being absorbed by the foam layer 34. The foam layer 34 may be the same cross-sectional thickness as the segments 24 or a different thickness. In general, the cross-sectional thickness of the foam layer 34 is between 0.5 mm and 5 mm, and more specifically in some embodiments, between 1 mm and 2 mm, and particularly about 1.5 mm.

Figure 2E:
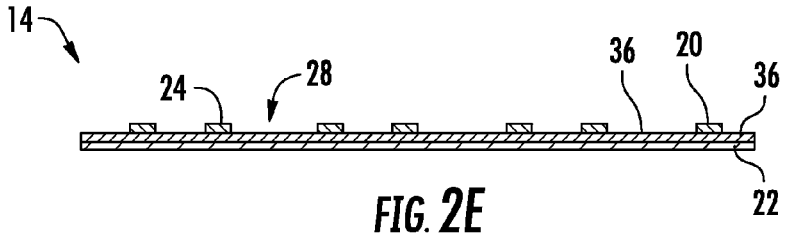
FIG. 2E shows a cross-sectional view of another exemplary embodiment of the auxetic arrangement of FIG. 2A further including a foam sublayer.

FIG. 2E shows a cross-sectional view of the auxetic layer 20 and base layer 22 according to another exemplary embodiment. In FIG. 2E, a foam layer 36 is provided between and couples the auxetic layer 20 to the base layer 22. The auxetic layer 20 and the base layer 22 may be coupled to the foam layer 36 using any of various means, including adhesives, molding, welding, sintering or any of various other means as will be recognized by those of ordinary skill in the art. The foam layer 36 is continuous and extends across the entire surface of the base layer 22 provided under the auxetic layer 20. Accordingly, the foam layer 36 may be referred to herein as a solid foam layer 36. The foam layer 36 may be comprised of any of various types of foam, such as polyurethane (PU) foam. However, it will be recognized that the foam may be comprised of any of various resilient materials, including other foam polymers. Because the foam layer 36 is resilient and elastic, the foam layer 36 will allow some expansion and contraction of the auxetic layer 20. However, because the foam layer 36 is continuous across the surface of the base layer 22 (and thus under the auxetic layer 20), the foam layer 36 provides some resistance to expansion and contraction of the auxetic layer 20. The resilient nature of the foam layer 36 also urges the auxetic layer 20 back to its static shape once a stretching force is removed from the auxetic layer 20. Again, the soft foam provided by the foam layer 36 provides additional padding to the arrangement, with additional impact forces to the auxetic layer being absorbed by the foam layer 36.

Figure 2F:
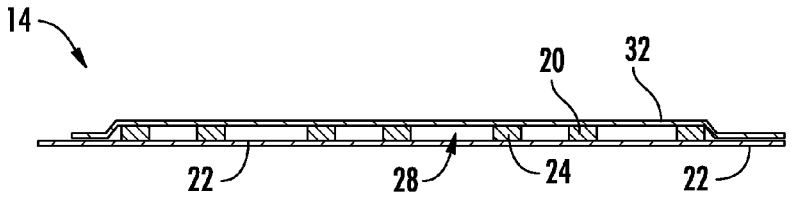
FIG. 2F shows a cross-sectional view of another exemplary embodiment of the auxetic arrangement of FIG. 2A further including a second elastic layer.

FIG. 2F shows a cross-sectional view of the auxetic layer 20 and base layer 22 according to yet another exemplary embodiment. In FIG. 2F, the article of apparel 16 includes an auxetic layer 20 sandwiched between an inner elastic layer (i.e., base layer 22) and an outer elastic layer 32. The outer elastic layer 32 may be comprised of the same or different material as the base layer 22, as described above, such as a four way stretch material. In this embodiment, the auxetic layer 20 is obscured from view, since the auxetic layer 20 is covered on both sides by layers of fabric on the inner base layer 22 and outer elastic layer 32. The outer elastic layer 32 provides additional resistance to expansion and contraction of the auxetic layer 20 over that provided when only a single elastic layer is provided as the base layer 22. Additionally, the outer elastic layer 32 provides additional resiliency to the arrangement, and urges the auxetic layer 20 back to its static shape once a stretching force is removed from the auxetic layer 20.

Figure 2G:
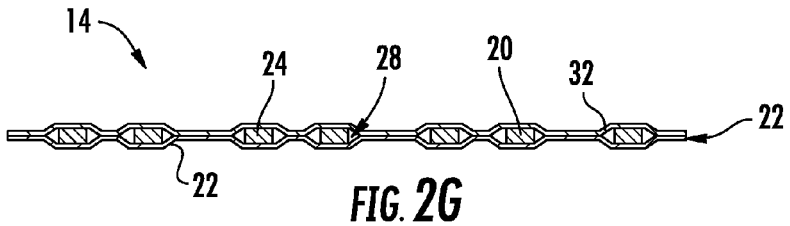
FIG. 2G shows a cross-sectional view of another exemplary embodiment of the auxetic arrangement of FIG. 2A further including a second elastic layer with interconnections of the elastic layers in the voids of the auxetic structure.

FIG. 2G shows a cross-sectional view of the auxetic layer 20 and base layer 22 according to another exemplary embodiment. In FIG. 2G, the article of apparel 16 includes an auxetic layer 20 sandwiched between an inner elastic layer (i.e., base layer 22) and an outer elastic layer 32, similar to that shown in FIG. 2F. However, in the embodiment of FIG. 2G, the outer elastic layer 32 is connected directly to the inner base layer 22 in the voids 28 of the auxetic layer 20. The connection between the outer elastic layer 32 and the inner base layer 22 may be accomplished in any of various ways as will be recognized by those of ordinary skill in the art, including the use of adhesives, molding, welding, sintering or any of various other means.

Figure 2H:
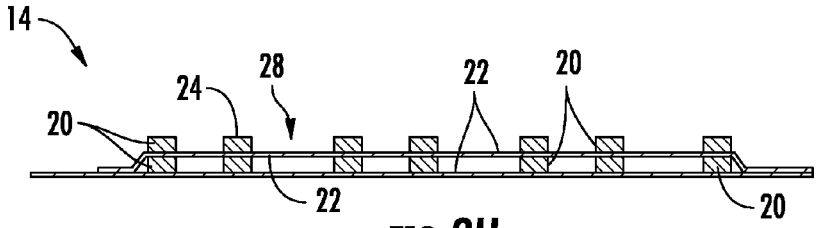
FIG. 2H shows a cross-sectional view of another exemplary embodiment of the auxetic arrangement of FIG. 2A further including a dual layer auxetic arrangement.

FIG. 2H shows a cross-sectional view of the auxetic layer 20 and base layer 22 according to another exemplary embodiment. The embodiment of FIG. 2H is similar to that of FIG. 2C, but in FIG. 2H, two layers of the auxetic layer 20 and base layer 22 are provided. In this embodiment, the segments 24 of the first auxetic layer are directly aligned with the segments of the second auxetic layer.

Figure 2I:
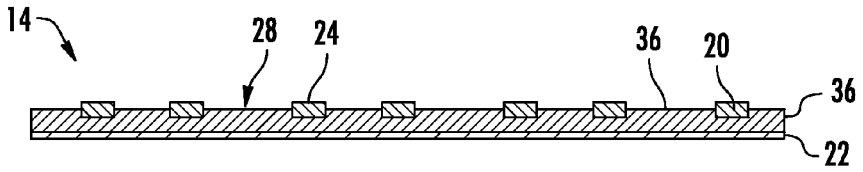
FIG. 2I shows a cross-sectional view of another exemplary embodiment of the auxetic arrangement of FIG. 2A further including a foam layer extending into voids in the auxetic structure.

FIG. 2I shows a cross-sectional view of the auxetic layer 20 and base layer 22 according to yet another exemplary embodiment. The exemplary embodiment of FIG. 2I is similar to that of FIG. 2E, but in the exemplary embodiment of FIG. 2I, the solid foam layer 36 extends partially into the voids 28 of the auxetic layer 20. In other words, the foam partially encapsulates the cells 26, partially surrounding the lateral sides of the segments 24 such that the top portion of the segments is exposed, protruding from the foam.

Figure 2J:
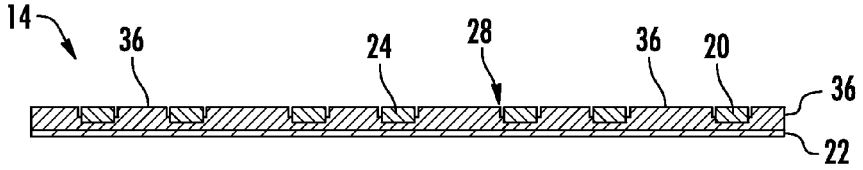
FIG. 2J shows a cross-sectional view of another exemplary embodiment of the auxetic arrangement of FIG. 2A further including a foam layer extending into voids in the auxetic structure and forming a substantially smooth outer surface with the segments of the auxetic layer.

FIG. 2J shows a cross-sectional view of the auxetic layer 20 and base layer 22 according to another exemplary embodiment. The exemplary embodiment of FIG. 2J is similar to that of FIG. 2I, but in the exemplary embodiment of FIG. 2I, the solid foam layer 36 extends completely through the voids 28 of the auxetic layer 20. In other words, the foam encapsulates the sides of the segments such that the top surface 29 of the auxetic layer is generally flush with the top surface of the foam layer 36. As a result, the outer surface of the arrangement is substantially smooth to the touch of a human, as the outer surface of the foam layer 36 is substantially coplanar with the outer surface of the segments 24.

While various exemplary embodiments of the auxetic arrangement 14 have been shown in the embodiments of FIGS. 2C-2J, it will be appreciated that features from these various embodiments may be easily incorporated into other embodiments. For example, the elastic outer layer 32 of FIG. 2F may be easily added to an embodiment with an intermediate foam layer 34 or 36 between the auxetic layer 20 and the base layer 22, such as that shown in FIG. 2D or 2E. As another example, a two layer arrangement such as that shown in FIG. 2H may be prepared using the auxetic arrangement with a foam layer 34 or 36.

Auxetic Structure on Skull Cap

Figure 4A:
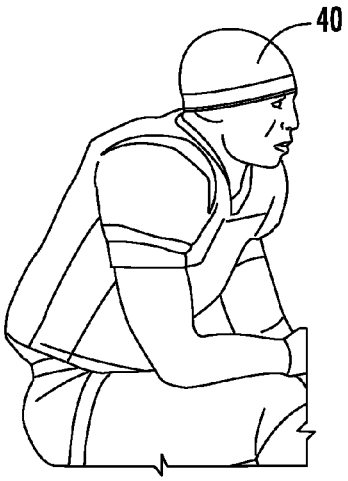
FIG. 4A shows a perspective view of an article of apparel incorporating the auxetic arrangement of FIG. 2A in a cap.
Figure 4B:
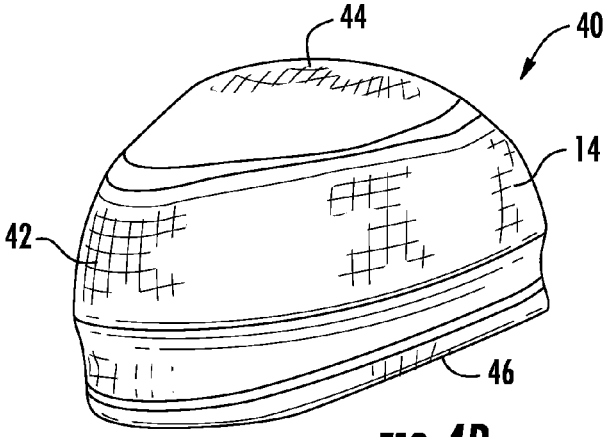
FIG. 4B shows a side view of the cap of FIG. 4A.
Figure 4C:
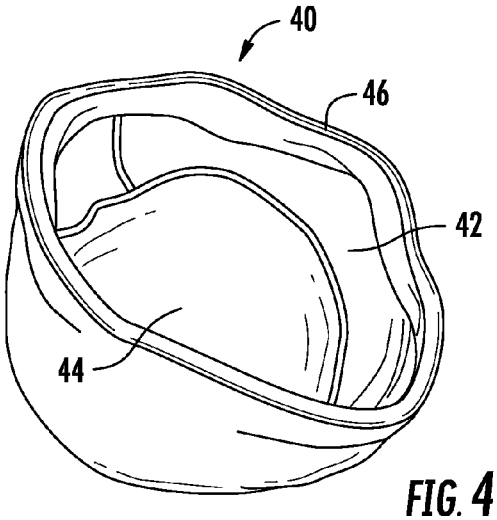
FIG. 4C shows a bottom perspective view of the cap of FIG. 4B.

With reference now to FIGS. 4A-4C, in at least one exemplary embodiment, the auxetic arrangement 14 described herein may be incorporated into skull caps 40 commonly worn under a football helmet. The skull cap 40 is used to provide additional protection for the wearer's head as well as allowing a tight fitting football helmet to more easily slip over the head. The auxetic arrangement 14 may be provided in various forms and in various locations on the cap 40. For example, the auxetic arrangement may include the elastic base layer 22 and the auxetic layer 20, as described above, incorporated into the crown or a middle region of the cap 40. The combination of the elastic base layer 22 in combination with the auxetic layer 20 having a negative Poisson's ratio allows the skull cap to closely fit a large number of different head sizes.

Additionally, protection can be provided to the wearer by providing an arrangement including the auxetic layer 20 and a shock absorbing foam material disposed on the base layer 22, such as the auxetic arrangement 14 shown in FIGS. 2D, 2E, 2I and 2J. The auxetic layer 20, in combination with the shock absorbing foam material, provides additional padding to protect the head from impacts commonly experienced during training or competition.

In the exemplary embodiment of FIGS. 4A-4C, the auxetic layer 20 is positioned between two compression layers, including inner base layer 22 and outer elastic layer 32, such as shown in FIG. 2F. Also, the auxetic arrangement 14 may be provided over the entire skull cap 40, or only over a portion of the skull cap. For example, the auxetic arrangement 14 may form the crown 44 of the cap. Alternatively or in addition, the auxetic arrangement may form a middle area 42 of the cap 40, between an upper crown portion 44 and a lower edge 46 of the cap 40.

Footwear with Auxetic Structure

With reference now to FIGS. 5A-8C, in an embodiment, the auxetic arrangement 14 is incorporated into a shoe. Traditionally, shoe uppers are patterned and cut in two-dimensional panels, and these two-dimensional panels are stitched together to form a general three-dimensional shape. With these traditional shoe uppers, the generic shape of the upper is often ill-fitting in specific areas that are difficult to form such as heel, ankle, arch, toes and instep. Accordingly, the auxetic arrangement 14 disclosed herein may be advantageously used to form various portions of shoes because the auxetic arrangement 14 is configured to smoothly fit multiple curvatures on the wearer without the need for numerous seams or cuts in the material. The auxetic arrangement 14 may be used to form a complete shoe upper or limited portions of the shoe upper, including the heel, ankle, arch, toes and instep.

Figure 5A:
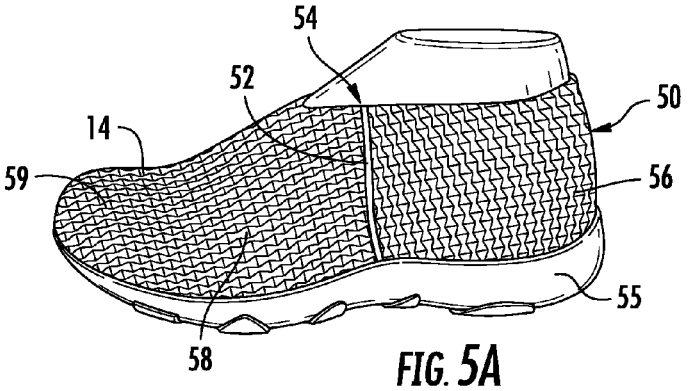
FIG. 5A shows a side view of an article of footwear showing an upper incorporating an auxetic arrangement.
Figure 5B:
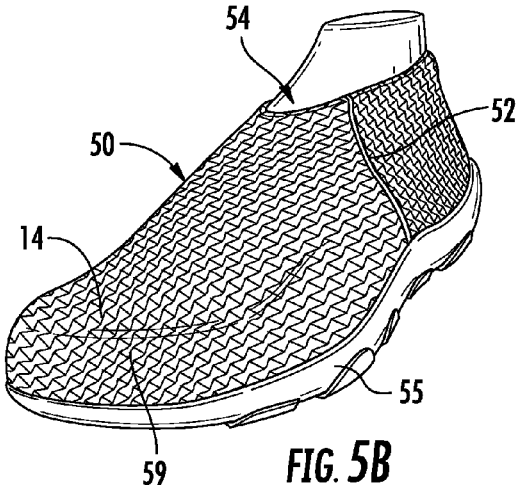
FIG. 5B shows a front perspective view of the article of footwear of FIG. 5A.
Figure 5D:
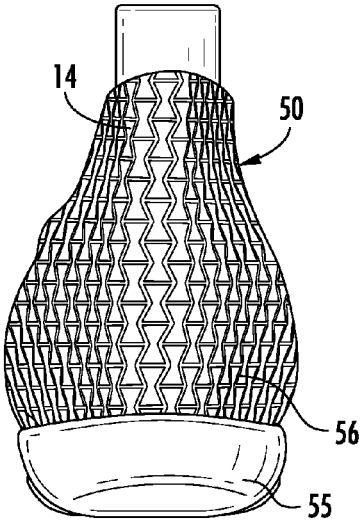
FIG. 5D shows a rear view of the article of footwear of FIG. 5A.
Figure 5C:
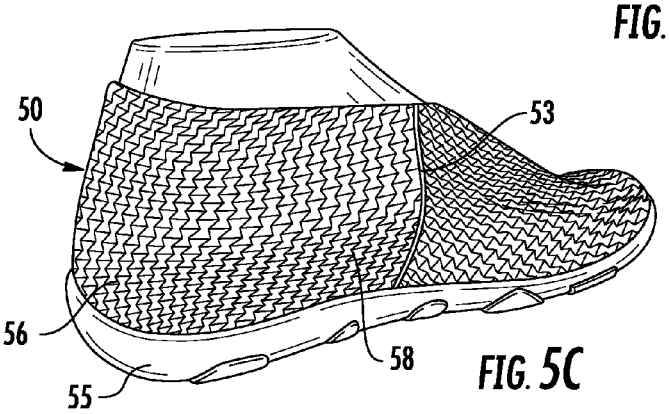
FIG. 5C shows a side perspective view of the article of footwear of FIG. 5A.

FIGS. 5A-5D illustrate one exemplary embodiment of the auxetic arrangement 14 used to form a fully auxetic shoe upper 50 with customized fit. As shown in FIGS. 5A-5D, the auxetic arrangement 14 may be cut into two panels having predetermined shapes, the panels contoured into the shape of a foot, and then joined along a medial seam 52 and a lateral seam 53 (see FIGS. 5B and 5C) to form the shoe upper 50 with opening 54 to receive the foot. The auxetic arrangement 14 described above, including the auxetic layer 20 in combination with the elastic base layer 22, is easily manipulated to form the multiple curved surfaces required for the shoe upper 50. As shown in the figures, it is possible to form the complete shoe upper 50 from only two pieces of the auxetic arrangement without wrinkling or folding of the material. These two pieces on the shoe upper 50 cover the entire foot, including the heel 56, midfoot 58 and toe regions 59. Although the embodiment of FIGS. 5A-5D shows a two-piece construction, in at least one alternative embodiment, a shoe upper with a one-piece construction may be formed using the auxetic arrangement 14 described herein. Once the shoe upper 50 is formed, it may be joined to a sole member 55, as shown in FIGS. 5A and 5B. Because of the auxetic arrangement 14, the shoe upper 50 has an elastic, expandable nature, allowing the shoe upper to provide a comfortable yet secure fit to various foot sizes and shapes.

Figure 6A:
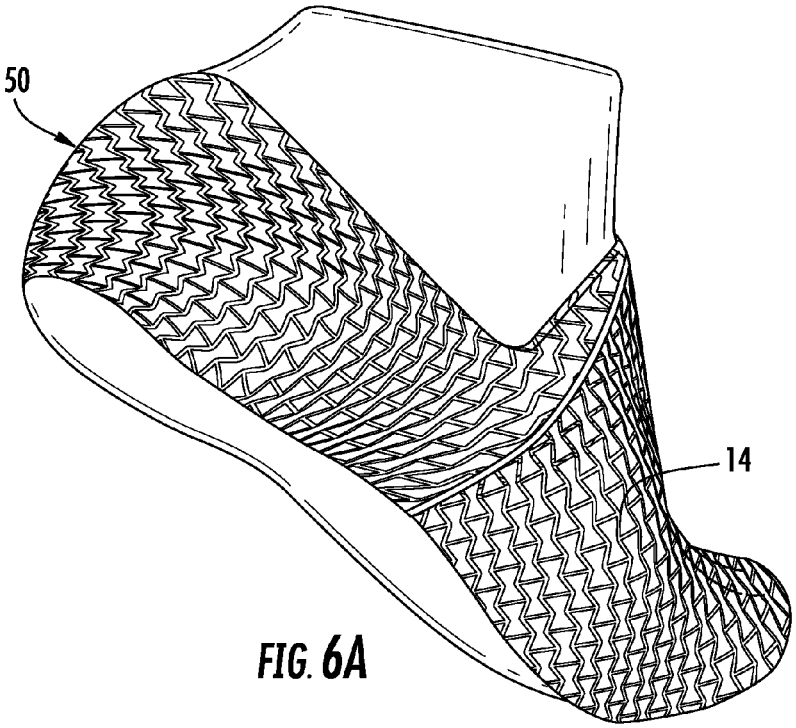
FIG. 6A shows an isolated, side perspective view of the shoe upper of the article of footwear of FIG. 5A, showing the upper in a flexed position.
Figure 6B:
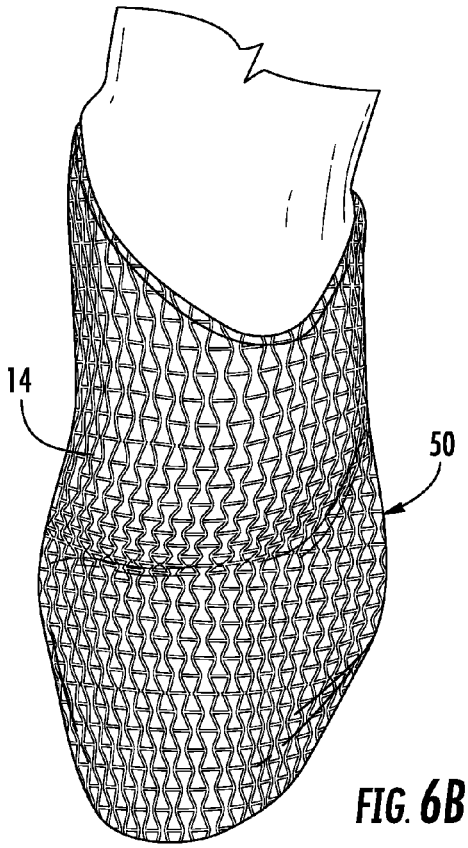
FIG. 6B shows a front perspective view of the shoe upper of the article of footwear in FIG. 6A.

FIGS. 6A and 6B show the shoe upper 50 of the article of footwear of FIGS. 5A-5D during an athletic activity, such as walking or running, where the foot of the wearer bends and flexes during the activity. As shown, the auxetic arrangement 14 allows the shoe upper 50 to continue to adhere closely (i.e., to contour) to the surface of the wearer's foot even as the foot flexes during athletic activity, with only limited bending or creasing of the auxetic arrangement 14.

Figure 7A:
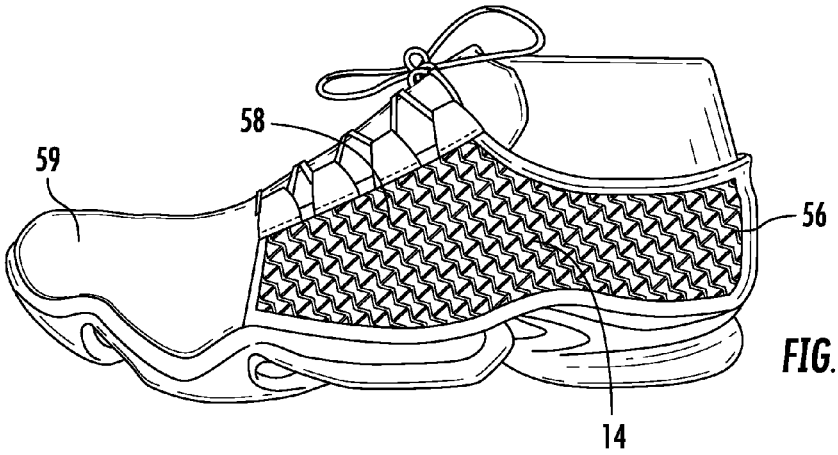
FIG. 7A shows a side perspective view of an article of footwear showing an upper incorporating an auxetic arrangement.
Figure 7B:
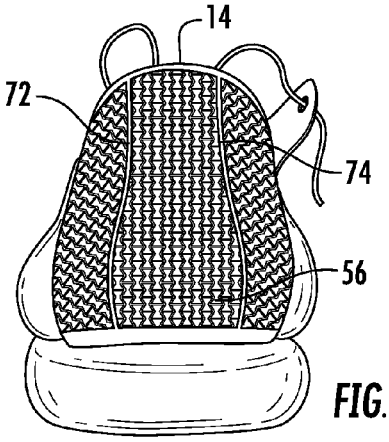
FIG. 7B shows a rear view of an article of footwear showing an upper incorporating an auxetic arrangement.
Figure 7C:
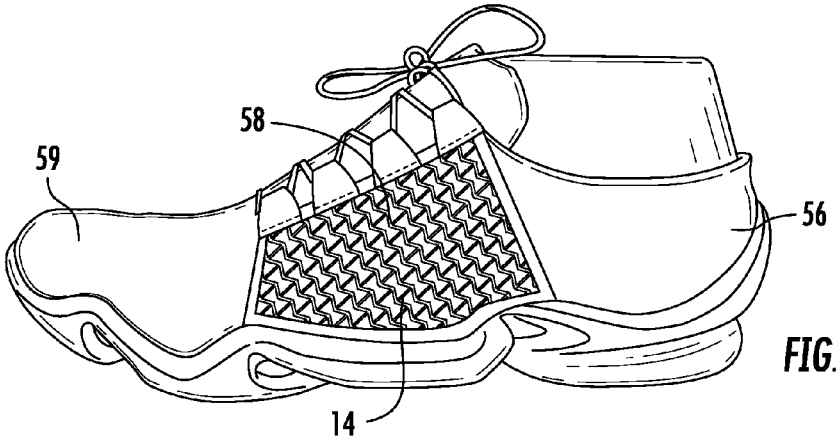
FIG. 7C shows a side perspective view of an article of footwear showing an upper incorporating an auxetic arrangement.

FIGS. 7A-8C show various exemplary alternative embodiments in which the auxetic arrangement 14 is used to form only a portion of the shoe upper 50. In FIGS. 7A-7B, the auxetic material forms the heel 56 and midfoot portions 58 of the shoe upper, but does not extend to the forefoot portions or toes. In this embodiment, a hot melt is included in the inner portion of the auxetic cells, as discussed above, causing the auxetic material to be more resilient and offer additional support. Additionally, as shown in FIG. 7B, two seams 72, 74 are provided in the heel portion 56 of the shoe, allowing the auxetic cells 26 to be positioned in a preferred orientation on the heel and both sides of the midfoot portion. This preferred orientation configures the shoe to anticipate forces that may act upon the shoe and associated directions where expansion or contraction of the panel with the auxetic arrangement 14 is most likely to be needed. FIG. 7C shows an alternative embodiment where the auxetic arrangement 14 is only provided on the midfoot portion 58 of the shoe, and does not extend back to the heel 56 or forward to the toe 59.

Figure 8A:
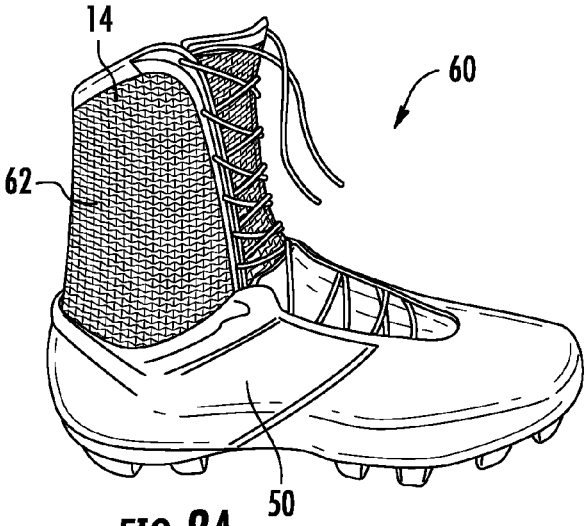
FIG. 8A shows a side perspective view of an article of footwear showing an upper incorporating an auxetic arrangement in an ankle portion.
Figure 8B:
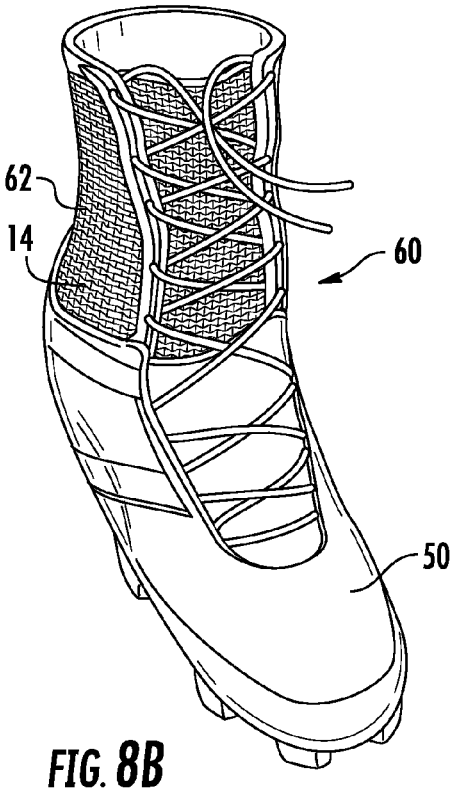
FIG. 8B shows a front perspective view of the article of footwear of FIG. 8A.
Figure 8C:
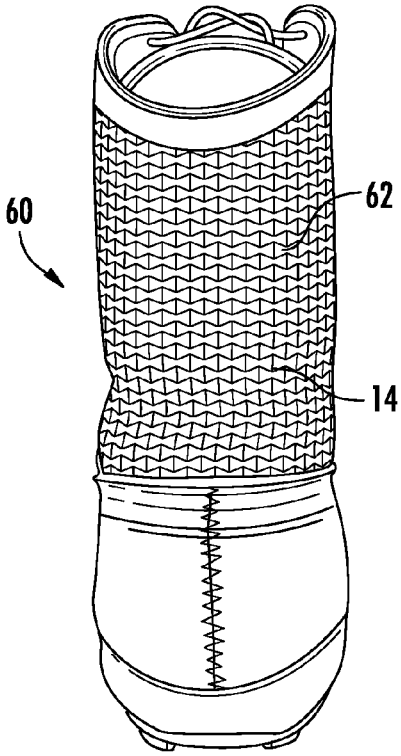
FIG. 8C shows a rear view of the article of footwear of FIG. 8A.

FIGS. 8A-8C show another exemplary embodiment of footwear including the auxetic arrangement 14 described above. In this exemplary embodiment, the auxetic arrangement 14 is provided on an upper ankle portion 62 of a high top cleat 60. The auxetic arrangement 14 extends completely around the ankle region without extending to the heel, midfoot, or toe region of the cleat 60. The auxetic arrangement 14 is not only provided on the side of the ankle portion 62, but is also included on the tongue. The auxetic arrangement 14 on the ankle portion 62 may be provided as a two-piece construction, with one piece provided on the tongue, and another piece provided on the remainder of the ankle portion 62. Accordingly, no seams are required in the ankle region other than where the auxetic arrangement 14 connects to the other portions of the upper 50. Because the auxetic arrangement 14 easily conforms to the curvatures of the wearer's ankle, the auxetic arrangement acts as an ankle wrap on the wearer's ankle when the laces of the cleat 60 are tightened. Again, depending on the desired fit and support level, the cells of the auxetic layer 20 may be filled with a resilient material or may be void of material.

Garments with Auxetic Structure

Figure 9A:
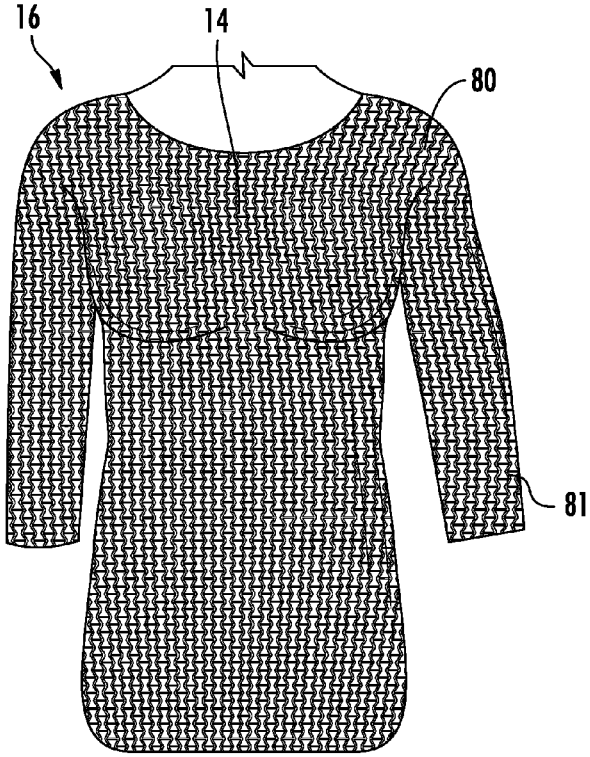
FIG. 9A shows a front view of an article of apparel showing a shirt incorporating an auxetic arrangement.
Figure 9C:
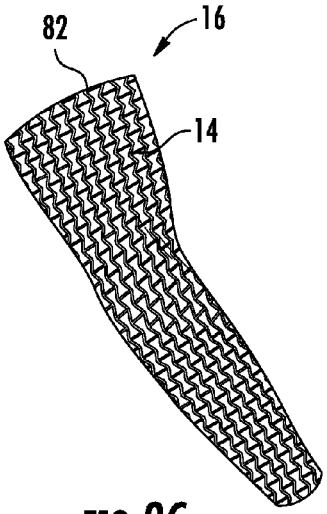
FIG. 9C shows a side view of an article of apparel showing an arm sleeve incorporating an auxetic arrangement.
Figure 9B:
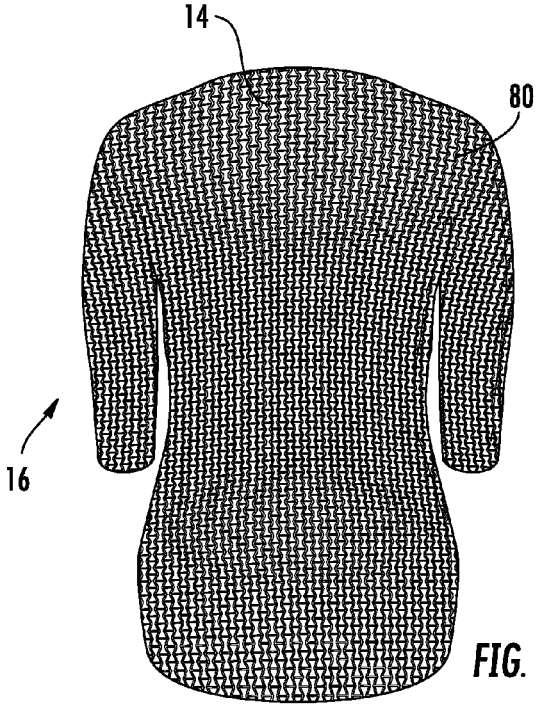
FIG. 9B shows a rear view of the article of apparel of FIG. 9A.

With reference to FIGS. 9A-9C, an exemplary embodiment of an article of apparel 16 is shown in the form of a shirt 80 including one or more panels formed the auxetic arrangement 14 described above. In the embodiment of FIGS. 9A-9B, the auxetic arrangement 14 extends over the entire surface of the shirt 80. However, in other alternative embodiment, the auxetic arrangement 14 may be provided on only certain areas of the shirt 80, such as the arms 81, the chest portion, the back portion, and/or the abdomen portion. As described previously, the auxetic layer 20 of the auxetic arrangement 14 may be formed from a molding process or may be formed by a printing process. If a printing process is used the auxetic layer 20 may be directly printed on the base layer 22, and the auxetic layer 20 will typically be much thinner than if the auxetic layer is a molded structure. For example, if the auxetic layer is printed, the thickness of the auxetic layer may be less than 1 mm.

FIG. 9C shows an alternative exemplary embodiment wherein the article of apparel 16 is an arm sleeve 82 that is separate from a shirt.

Figure 10A:
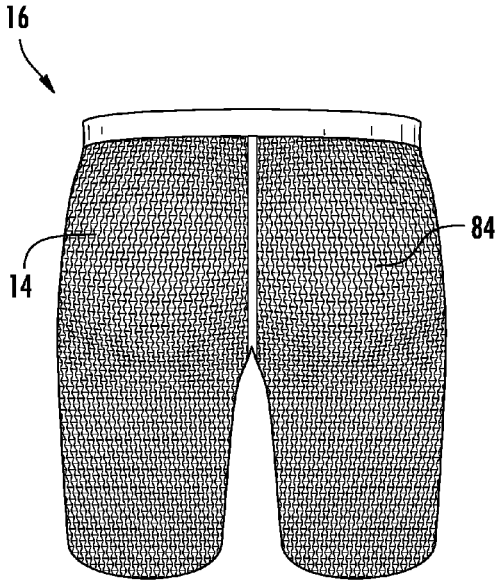
FIG. 10A shows a front view of an article of apparel showing shorts incorporating an auxetic arrangement.
Figure 10B:
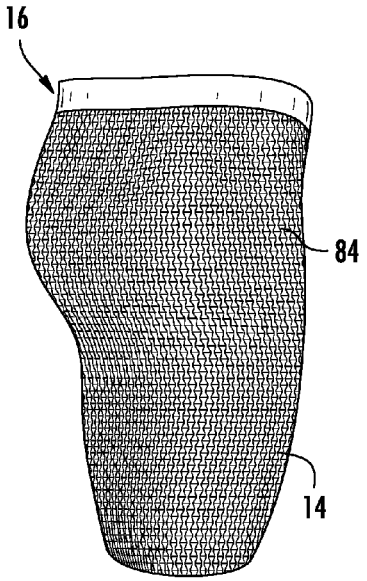
FIG. 10B shows a side view of the article of apparel of FIG. 10A.
Figure 10C:
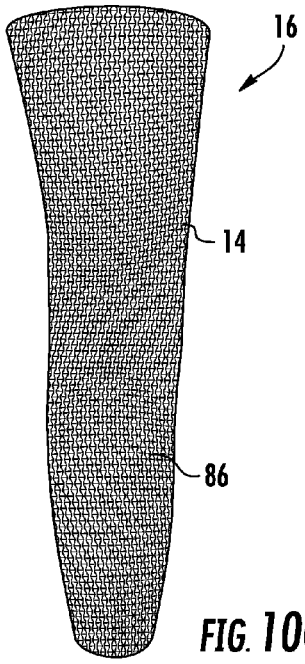
FIG. 10C shows a front view of an article of apparel showing a leg sleeve incorporating an auxetic arrangement.

FIGS. 10A-10B show an alternative exemplary embodiment wherein the article of apparel 16 is a short 84. Likewise, FIG. 10C shows an alternative exemplary embodiment wherein the article of apparel 16 is a leg sleeve 86. Each of these embodiments of FIGS. 9C-10C is similar to the embodiment of FIGS. 9A-9B, but the auxetic arrangement 14 is simply provided on a different article of apparel 16.

Accessory Articles of Apparel with Auxetic Structure

Figure 11A:
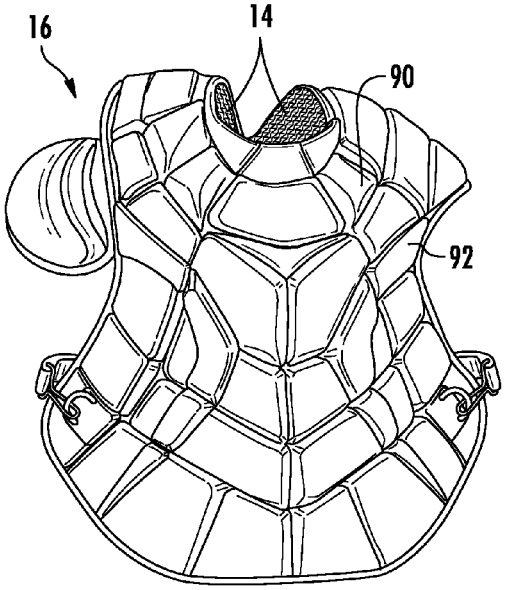
FIG. 11A shows a front view of an article of apparel showing a chest protector incorporating an auxetic arrangement.
Figure 11B:
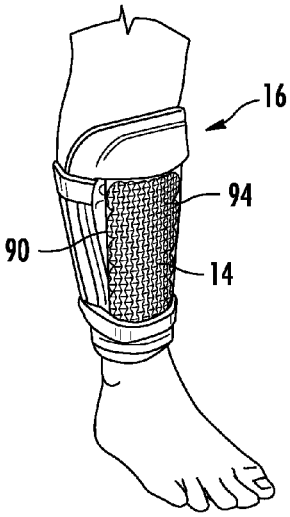
FIG. 11B shows a front perspective view of an article of apparel showing a shin guard incorporating an auxetic arrangement.
Figure 11C:
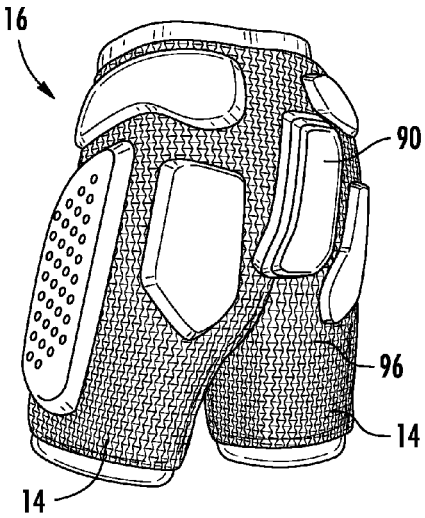
FIG. 11C shows a side perspective view of an article of apparel showing a protective pad incorporating an auxetic arrangement.
Figure 12:
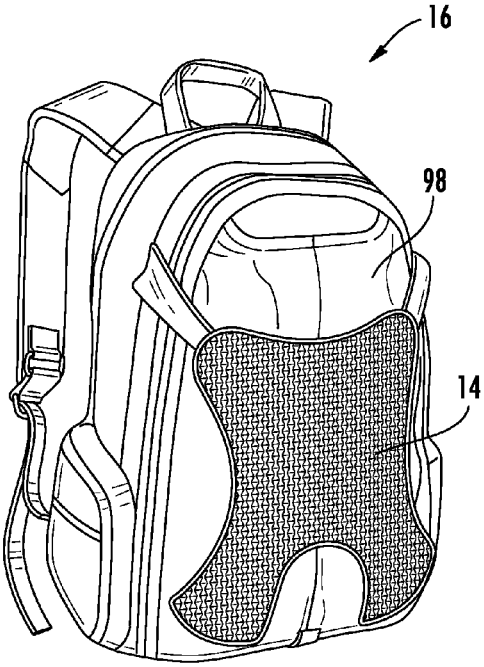
FIG. 12 shows a front perspective view of an article of apparel showing a backpack incorporating an auxetic arrangement.

As discussed above, the auxetic arrangement 14 may be provided on any of various articles of apparel 16. Additional examples of articles of apparel that may incorporate the auxetic arrangement 14 include protective pads 90 such as those shown in FIGS. 11A-11C, including the chest protector 92 of FIG. 11A, the shin guards 94 of FIG. 11B, or the protective girdle 96 of FIG. 11C. In yet another exemplary embodiment, the auxetic arrangement 14 may be provided in association with a bag, such as backpack 98 of FIG. 12. When a bag such as backpack 98 includes a panel incorporating the auxetic arrangement 14, and the panel is subjected to forces associated with carrying a load, the bag (and particularly the panel including the auxetic arrangement 14) will actually expand in size. Other exemplary uses for the auxetic arrangement in association with a bag include the use of the auxetic arrangement 14 on a strap for the bag, as explained in further detail below with reference to FIGS. 13A-14D.

Figure 13A:
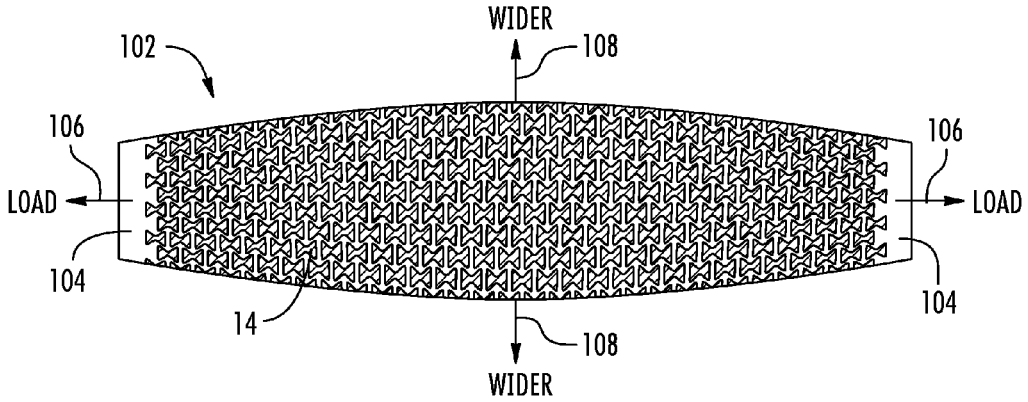
FIG. 13A shows a plan view of an article of apparel showing a shoulder pad incorporating an auxetic arrangement.
Figure 13B:
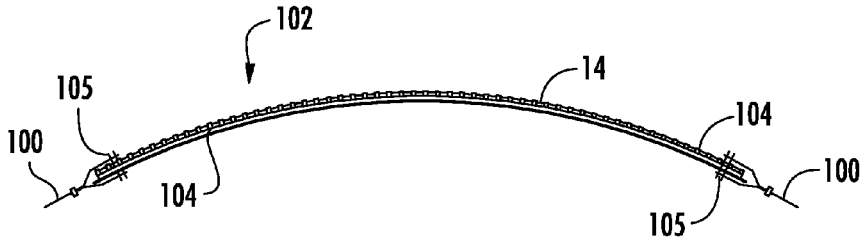
FIG. 13B shows a side view of the shoulder pad of FIG. 13A and an associated strap.

With reference to FIGS. 13A-13B in one exemplary embodiment, the article of apparel 16 is a shoulder pad 102 including an auxetic arrangement 14 coupled to a carrying strap 100, and the auxetic arrangement 14 is included on the shoulder pad 102. As shown in FIG. 13B, the ends 104 of the shoulder pad 102 are directly connected to the carrying strap 100 by stitching 105 or other fastening means. The carrying strap 100, in turn, may be coupled to a bag (not shown) or any other carrying device or load. As shown in FIG. 13A, when a load 106 is applied to the ends 104 of the shoulder pad 102, the auxetic arrangement 14 expands in the direction of the applied load 106 and also in a direction 108 that is perpendicular to the applied load. As a result, the auxetic arrangement 14 of the shoulder pad 102 provides an increased surface area configured to bear the weight of the load. The increased surface area provided by the shoulder pad 102 makes carrying the load more comfortable for the user, as the weight of the load is spread across a greater area on the user's shoulder.

Figure 14A:
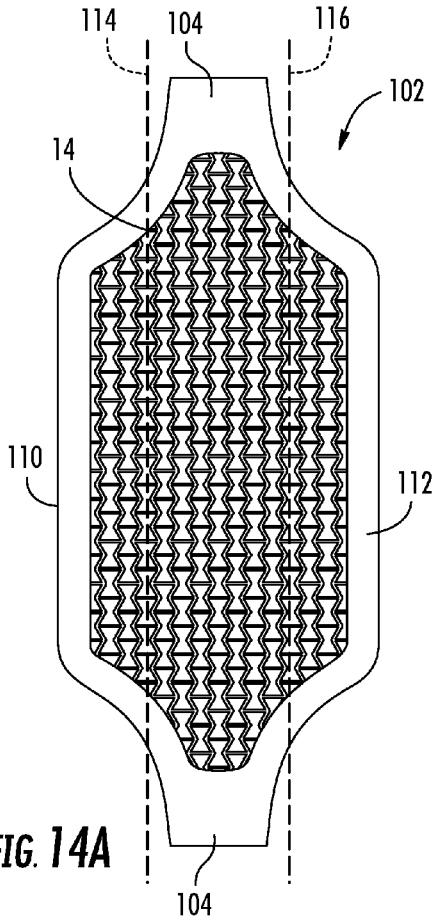
FIG. 14A shows a plan view of an article of apparel showing a shoulder pad incorporating an auxetic arrangement.
Figure 14C:
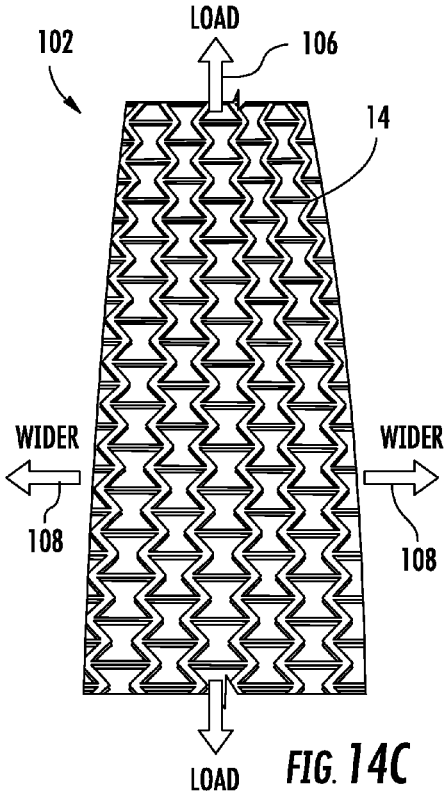
FIG. 14C shows a front perspective view of the shoulder strap of FIG. 14B.
Figure 14B:
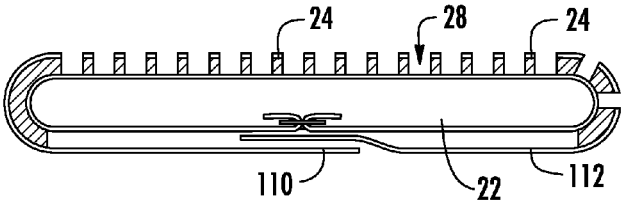
FIG. 14B shows a cross-sectional view of the shoulder pad of FIG. 14A configured for use with a shoulder strap.
Figure 14D:
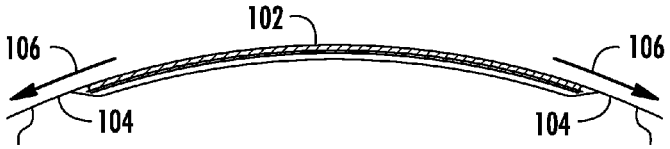
FIG. 14D shows a side view of the shoulder pad of FIG. 14A and an associated strap.

With reference now to FIGS. 14A-14D, an alternative embodiment of a shoulder pad 102 and carrying strap arrangement is shown. In this embodiment, the shoulder pad 102 is manufactured such that the auxetic arrangement 14 has the shape shown in FIG. 14A, including flared sides 110 and 112. As shown in FIG. 14B, the flared sides 110, 112 are folded under and connected together during manufacture of the shoulder pad 102, thus creating a two-layer shoulder pad. As a result, the longitudinal edges of the shoulder pad 102 are positioned along the dotted lines 114, 116 as shown in FIG. 14A. As shown in FIG. 14C, when a load 106 is applied to the ends 104 of the shoulder pad 102, the auxetic arrangement 14 expands in the direction of the applied load 106 and also in a direction 108 that is perpendicular to the applied load. As a result, the auxetic arrangement 14 of the shoulder pad 102 provides an increased surface area configured to bear the weight of the load. The increased surface area provided by the shoulder pad 102 makes carrying the load more comfortable for the user, as the weight of the load is spread across a greater area on the user's shoulder.

While the foregoing description provides a few limited exemplary embodiments of the auxetic arrangement 14 and associated use in various items of apparel, it will be recognized that numerous other embodiments are possible and contemplated although such additional embodiments are not specifically mentioned herein. For example, the auxetic material disclosed herein may also be used in scarves, gloves, hats, socks, sports bras, jackets, outdoor and hunting clothing, undergarments, elbow and knee pads, braces, bands, and various other articles of apparel.

Auxetic Structure Orientation based on Coupling Arrangement Edges or Base Layer

Figure 15A:
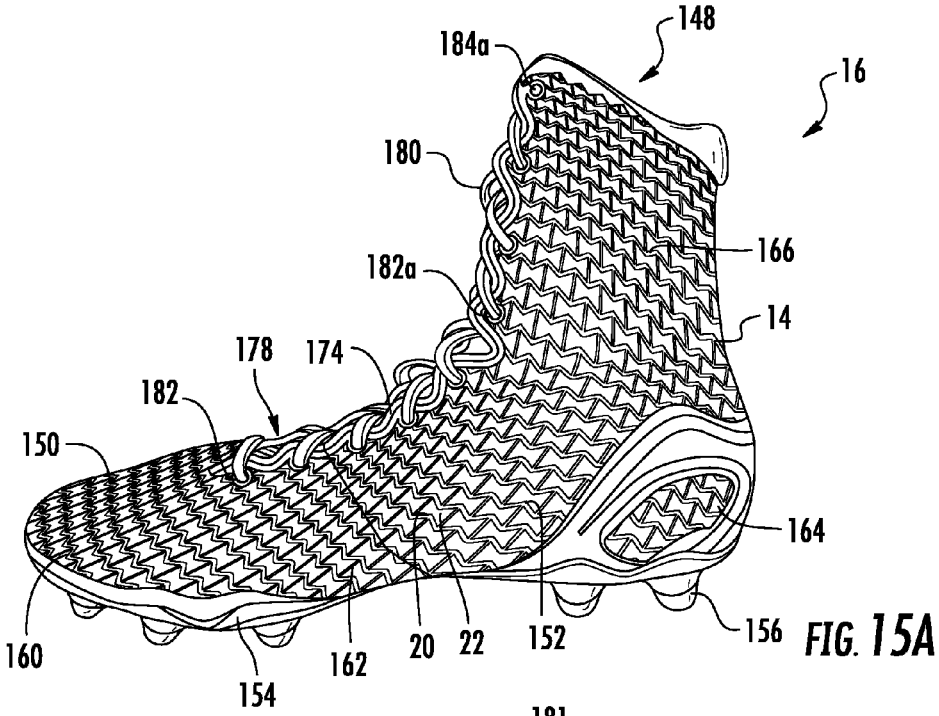
FIG. 15A shows a side view of an article of footwear showing a high-top shoe incorporating an auxetic structure.
Figure 15B:
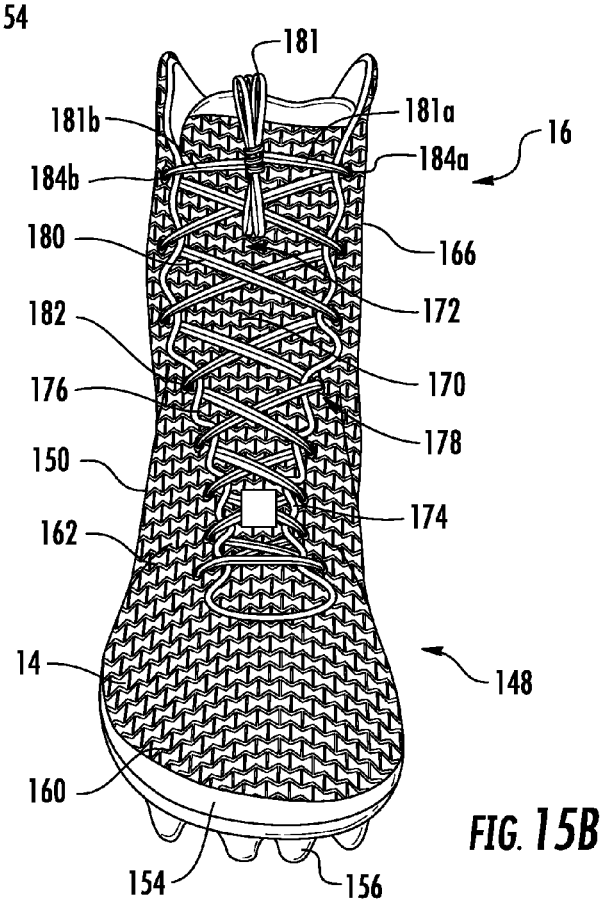
FIG. 15B shows a front view of the article of footwear of FIG. 15A.

With reference now to FIGS. 15A-15B, in one exemplary embodiment, the article of apparel 16 is an article of footwear in the form of a high-top shoe 148 with the auxetic arrangement 14 provided on the shoe 148. The shoe 148 includes a sole 154 and a shoe upper 150. The sole 154 is generally comprised of a durable polymer material, such as a synthetic rubber. In the embodiment of FIGS. 15A-15B, the shoe 148 is cleated, including one or more traction elements (e.g., spikes 156, cleats, or other projections) extending downward from the bottom surface of the sole 154. In other embodiments, the sole 154 may be generally flat with numerous grooves, such as the sole of a typical basketball shoe.

The shoe upper 150 includes a forefoot region 160, a midfoot region 162, and a heel region 164. Also, because the shoe 148 possess a "high-top" configuration, the shoe upper 150 further includes an ankle region 166 that covers and extends above the ankle of the wearer. Similar to the arrangement of FIGS. 5A-8C, the shoe upper 150 is formed from one or more panels 152 including the auxetic arrangement 14. In the embodiment of FIGS. 15A and 15B, the auxetic arrangement 14 includes an auxetic layer 20 and a base layer 22. As described above, the base layer 22 is formed of resilient material, such as compression fabric with two-way or four-way stretch capability or a solid elastomer layer (e.g., thermoplastic polyurethane (TPU)).

The shoe upper 150 further includes a tongue 170 positioned within a tongue opening 172. The tongue opening 172 extends between a central medial edge 174 and a central lateral edge 176 in the midfoot region 162 of the shoe upper 150. The shoe 148 further includes a lace coupling arrangement 178, including a lace 180 with a lace end 181 and a plurality of lace couplings 182*a*, 182*b* positioned along each of the medial edge 174 and the lateral edge 176 (i.e., on opposite sides of the tongue opening 172), respectively. In the embodiment of FIGS. 15A-15B, the lace couplings 182*a*, 182*b* are in the form of eyelets extending through the shoe upper 150. In other embodiments, the lace couplings 182*a*, 182*b* may be provided in different forms, as will be recognized by those of ordinary skill in the art. For example, the lace couplings 182*a*, 182*b* may be provided by loops, flanges, or other structures coupled to the shoe upper 150. Adjacent lace couplings 182*a*, 182*b* are formed by two side-by-side lace couplings positioned along either the medial edge 174 or the lateral edge 176 of the shoe upper 150. In operation, the lace 180 passes through each of the lace couplings 182*a*, 182*b*, with the lace ends 181*a*, 182*b* extending from a respective uppermost lace coupling 184*a*, 184*b*. With this configuration, a force pulling on the lace ends 181*a*, 181*b* draws the lace couplings 182*a*, 184*b* positioned along the medial edge 174 toward to the lace couplings 182*b*, 184*b* positioned along the lateral edge 176, closing the opening and securing the shoe 148 to the foot.

Figure 16A:
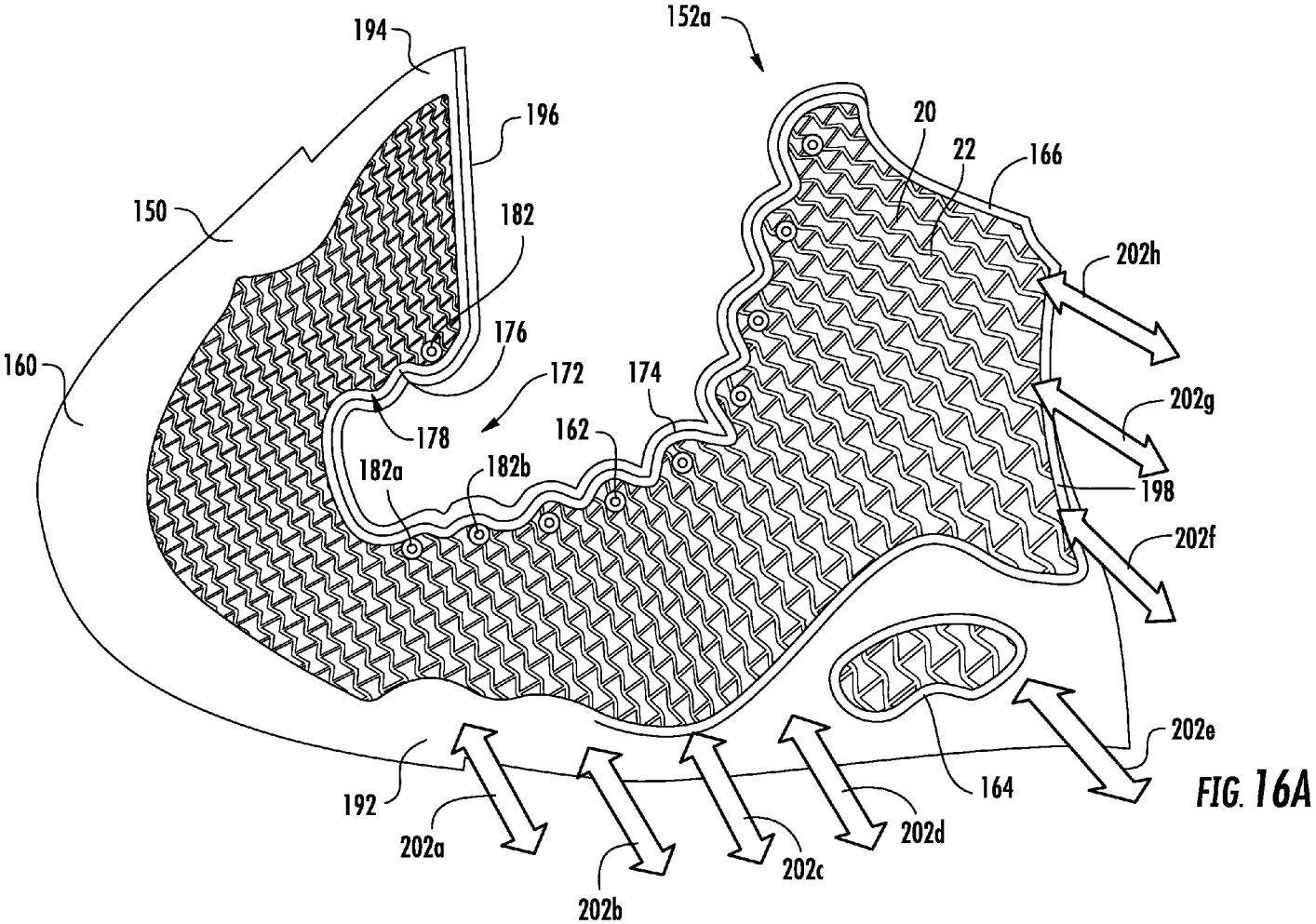
FIG. 16A shows a plan view of a panel of an upper of the shoe of FIG. 15A prior to assembly of the upper on a sole of the shoe.

FIG. 16A shows a panel 152 of the shoe upper 150. The panel 152 includes an auxetic arrangement with a base layer 22 and an auxetic layer 20, similar to the arrangement described above with references to FIGS. 1A-2C. The panel 152 is configured to provide most of the area of the shoe upper 150 and thus includes both a medial side 192 and a lateral side 194. Specifically, the panel lateral side 194 extends across the forefoot region 160, the midfoot region 162, the heel region 164, and the ankle region 166 of the shoe upper 150. The panel medial side 192 extends from the forefoot region 160 to the midfoot region 162 of the shoe upper 150.

The panel 152 is configured such that the tongue opening 172 is formed between the medial side 192 and the lateral side 194 of the shoe upper 150. The tongue opening 172 is defined between the central medial edge 174 and the central lateral edge 176. A plurality of lace couplings 182*a*, 182*b* are provided on the single panel 152. A second panel (not shown in FIG. 16A) is coupled to the single panel 152 shown in FIG. 16A to form the shoe upper 150.

In an embodiment, the panel 152 is one of two panels 152 that cooperate to form the shoe upper 150. The panels 152 are connected at a lateral midfoot seam 196 and at a rear seam 198 of the shoe upper 150.

Figure 16B:
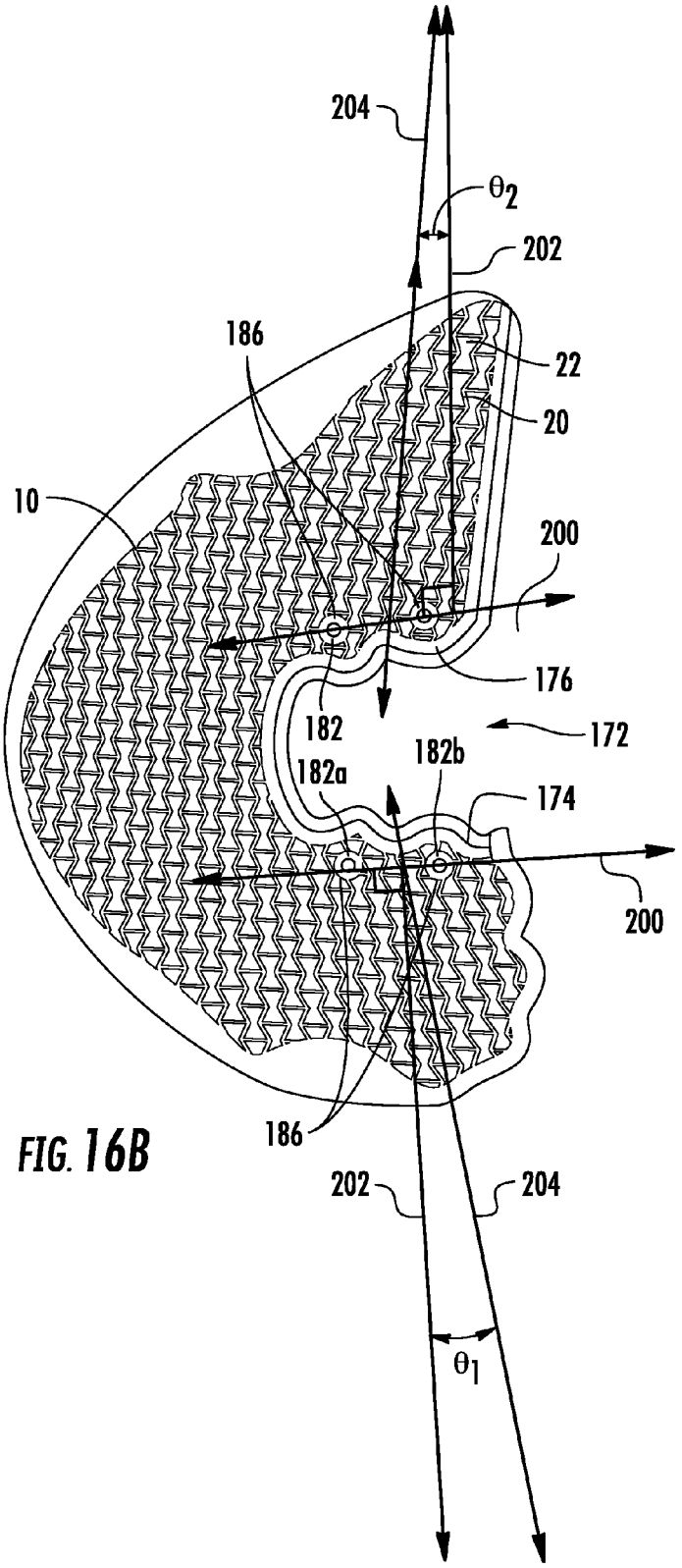
FIG. 16B shows a plan view of a front portion of the panel of FIG. 16A showing a primary elongation direction of the auxetic structure in substantial alignment with a lace pull direction of the shoe.

As best shown in FIG. 16B, adjacent lace couplings on one side (i.e., along either the medial edge 174 or lateral edge 176) of the tongue opening 172 define lace coupling pairs 186. Each lace coupling pair 186 on the shoe 148 defines at least one line 200 (FIG. 16B) extending through the two adjacent lace couplings 182*a*, 182*b* of the lace coupling pair 186. A lace pull direction, indicated by a line 202, is perpendicular to the line 200 extending through the two adjacent lace couplings 182*a*, 182*b* of the lace coupling pair 186. The primary elongation direction of the auxetic structure positioned between two adjacent lace couplings 182*a*, 182*b* (indicated by line 204 in FIG. 16B) is substantially in alignment with the lace pull direction 202 defined by the two adjacent lace couplings 182*a*, 182*b*. In particular, the primary elongation direction 204 of the auxetic layer 20 between a lace coupling pair 186 is within a predetermined angle θ of the lace pull direction 202 defined by the lace coupling pair 186. In the embodiment of FIG. 16B, the angle θ is less than 15 degrees, and generally about ten degrees. In other embodiments, the angle θ may be less than 20 degrees, less than ten degrees, or less than five degrees. The primary elongation direction 204 of the auxetic structure is considered to be "substantially in alignment with the lace pull direction" when the angle θ is less than twenty degrees. For purposes of this disclosure, the portion of the auxetic layer 20 that extends in a generally perpendicularly outward direction from the points on a line 200 extending between a lace coupling pair 186 is considered to be positioned "between" the lace coupling pair.

It will be noted that the lace pull direction 202 for the upper 150 changes from one lace coupling pair 186 to the next, based on the position of each lace coupling 182*a*, 182*b* on the shoe upper. While FIG. 16B shows the lace pull direction 202 for the two foremost lace coupling pairs on the shoe 148, it will be recognized that numerous lace coupling pairs exist on the shoe 148, and the lace pull direction may gradually change from the foremost lace coupling pair to the rearmost lace coupling pair on the shoe (i.e., from the lace coupling pair closest to the forefoot region 160 to the lace coupling pair closest to the heel region 164). The arrows 202*a*-202*h* of FIG. 16A generally illustrate the changing direction of the lace pull direction 202 between the foremost and the rearmost lace coupling pairs. In the embodiment of FIG. 16A the lace pull direction 202 changes by more than 45 degrees, and particularly between about 65 degrees between the foremost lace coupling pair and the rearmost lace coupling pair of the shoe 148.

Figure 16C:
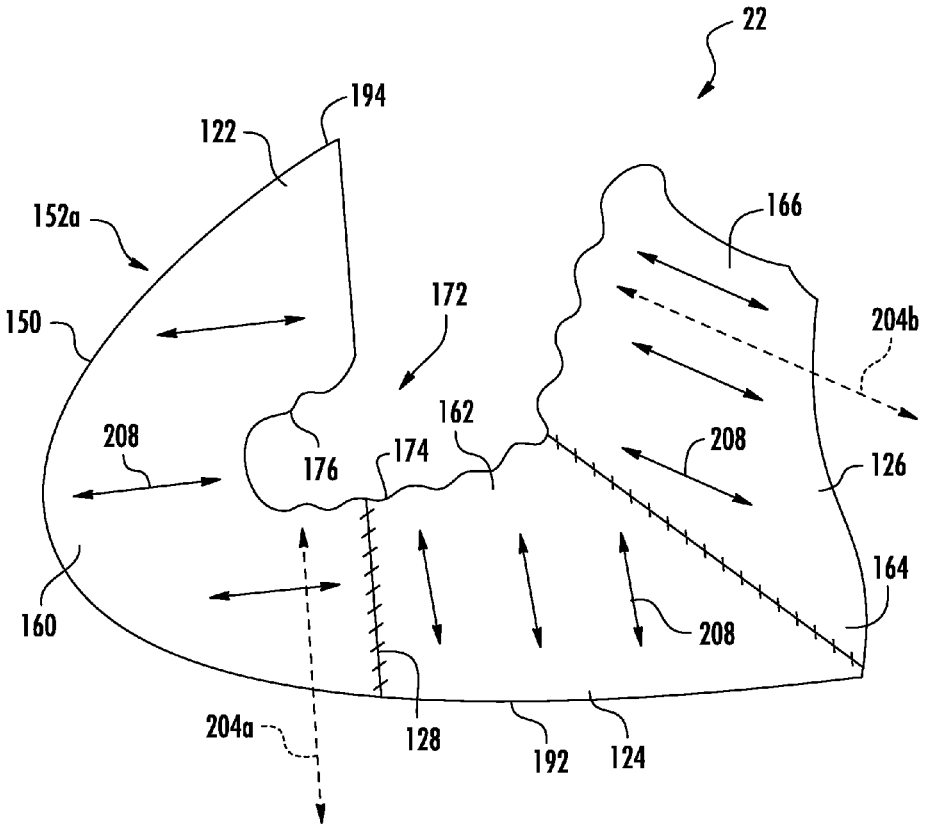
FIG. 16C shows a plan view of an alternative embodiment of the base layer of the panel of FIG. 16A, wherein the base layer is comprised of a plurality of sheets of two way stretch fabric with the stretch direction of the sheets differently oriented.

With reference now to FIG. 16C, in at least one embodiment, the base layer 22 of the panel 152 includes a plurality of sheets of two-way stretch fabric. In particular, in FIG. 16C, the base layer 22 includes three different sections or sheets of two-way stretch fabric, particularly including a first sheet 122, a second sheet 124, and a third sheet 126. The sheets 122, 124, 126 may be directly coupled together, such as by stitching 128 along a seam, or indirectly coupled together, such as by the integrally formed auxetic layer 20 extending across two different sheets of the base layer 22 with each sheet directly connected to the auxetic layer 20 but not directly connected to each other. The base layer 22 in FIG. 16C is configured for use as the base layer 22 of the panel 152 of FIG. 16A. Accordingly, the base layer 22 includes a medial side 192, a lateral side 194, a forefoot region 160, a midfoot region 162, a heel region 164, and an ankle region 166, with a shape and size generally equivalent to the shape and size of the panel of FIG. 16A. The base layer 22 also includes a tongue opening 172 defined between a medial edge 174 and a lateral edge 176.

The two-way stretch fabric used for the sheets 122, 124 and 126 means that each sheet stretches a substantial amount along a first axis, but stretches to a much lesser amount, or is substantially inelastic, along a second axis that is generally perpendicular to the first axis. As shown in FIG. 16C, each of the sheets 122, 124, and 126 are oriented on the base layer 22 such that the two-way stretch direction, illustrated by arrows 208, is different on each sheet. For example, the first sheet 122 (in the forefoot region 160) is configured to stretch in a direction that is nearly perpendicular to the stretch direction of the second sheet 124 (forming the midfoot region 162). Also, the third sheet 126 (in the ankle region 166) is configured to stretch in a direction that is angled approximately 45 degrees relative to the stretch direction of the first sheet 122.

The dotted line axes 204*a* and 204*b* in FIG. 16C denote a primary elongation direction for the auxetic layer 20 at different locations on the panel 152. Because the underlying base layer 22 shown in FIG. 16C is configured to stretch differently in different areas of the base layer 22, the stretch performance of the panel 152 will be different in different areas of the panel. In particular, because the primary elongation direction 204*a* of the auxetic structure in the forefoot region 160 is perpendicular to the two-way direction of stretch 208 of the base layer 22, and because the primary elongation direction 204*b* of the auxetic structure in the ankle region 166 is parallel to the two-way direction of stretch 208 of the base layer 22, the overall stretch characteristics in these two regions will differ.

In yet other embodiments, the base layer 22 may include sheets of different types of material that are coupled together to provide differing stretch characteristics throughout the panel 152. For example, the forefoot region 160 of the panel 152 could include a two-way stretch fabric, the midfoot region 162 of the panel could include a non-stretch polymer sheet, and the ankle region 166 of the panel could include a four-way stretch fabric. In this manner, the designer of a shoe or other article may control stretch characteristics in different areas of the article.

Figure 17:
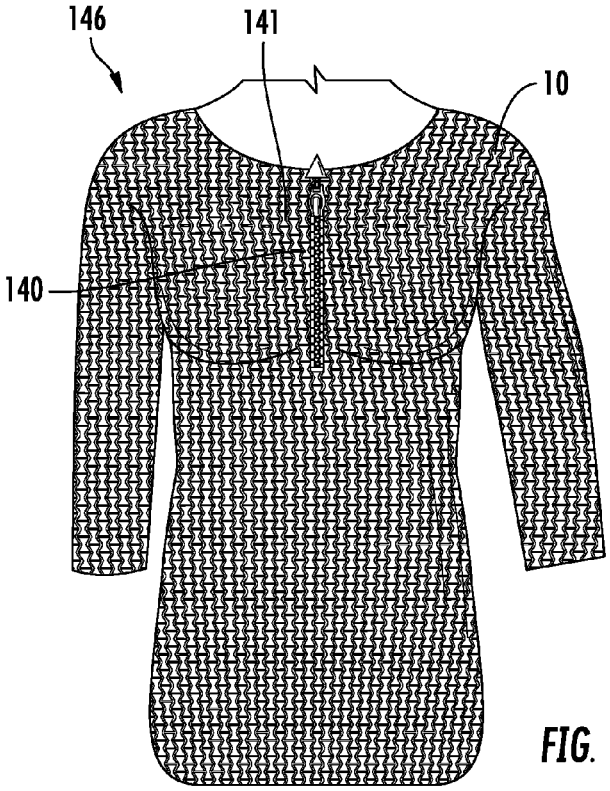
FIG. 17 shows an article of apparel in the form of a shirt incorporating the auxetic structure of FIG. 1A.
Figure 18:
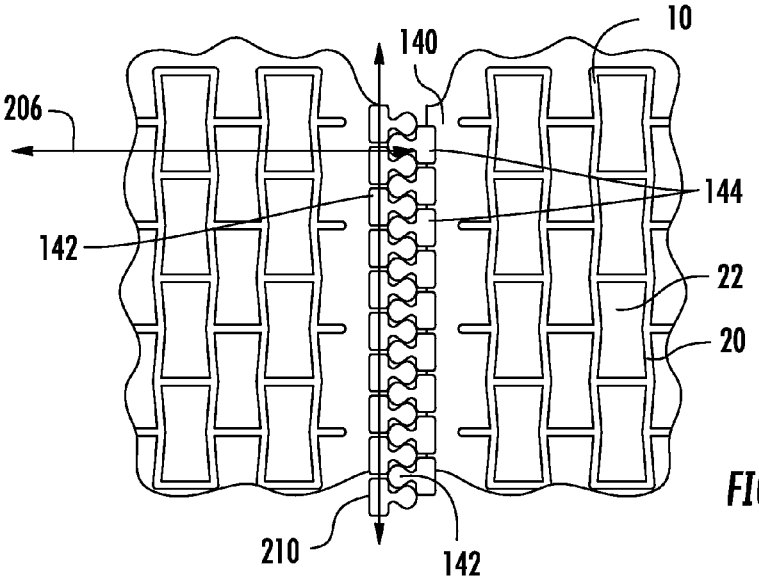
FIG. 18 shows a coupling arrangement for the shirt of FIG. 17, wherein the coupling arrangement is provided as a zipper.

In the foregoing embodiment, the auxetic structure 10 is oriented on a shoe 148 such that the primary elongation direction 204 is disposed in a predetermined orientation relative to a lace coupling arrangement 178. In other embodiments, however, the auxetic structure 10 may be provided on different articles, and the orientation of the auxetic structure 10 may be selected relative to different types of coupling arrangements. For example, FIGS. 17 and 18 show an embodiment wherein the auxetic structure 10 is provided on a shirt 146. The shirt 146 includes a coupling arrangement in the form of a zipper 140 with a zipper pull 141 in a central chest region of the shirt. As shown in FIG.

18, the zipper 140 includes a plurality of coupling members in the form of zipper teeth 142. Adjacent teeth define a tooth pair 144. A secondary elongation direction 206 of the auxetic structure 10 on the shirt 146 is substantially perpendicular to a line 210 drawn through at least one tooth pair 144. Accordingly, the secondary stretch direction of the auxetic structure 10 is substantially parallel to a pull direction of the teeth of the zipper 140.

Thus, in an embodiment, the shoe includes a resilient base layer 22 with an auxetic layer 20 disposed (via, e.g., printing or coating) on the surface of the base layer. The base layer 22 may be divided into a plurality of sections or sheets, each having a predetermined stretch pattern. As noted above, the first section or sheet 122 stretches generally longitudinally, i.e., in a first direction along the longitudinal axis of the shoe. By way of specific example, the first sheet 122 may stretch forward, along the longitudinal axis of the shoe and parallel to the toes. The second section or sheet 124 stretches in a direction that is generally orthogonal to the first direction. By way of specific example, the second sheet 124 stretches vertically (e.g., downward), along the side of the foot. The third section or sheet 126 stretches in third direction offset from the first and second directions. By way of example, the third sheet 126 may stretch at 45° angle relative to the shoe sole.

The auxetic layer 20 is disposed on the base layer 22 (i.e., on each sheet 122, 124, 126) in a predetermined orientation relative to the stretch direction of the base layer. That is, the auxetic layer 20 is oriented to permit, restrict, or direct the stretch pattern of the base layer. In an embodiment, the auxetic layer 20 is attached to the base layer 22 such that the primary elongation direction aligns with the stretch direction of the substrate. Alternatively, the auxetic layer 20 is attached to the base layer 22 such that the secondary elongation direction aligns with the stretch direction of the substrate. With this configuration, while the base layer is generally the dominant layer in the auxetic arrangement 14 (expanding the auxetic layer when a load is applied and contracting the auxetic layer when the load is removed), the manner in which the base layer stretches, particularly in the secondary direction, is driven by the auxetic layer 20.

Accordingly, apparel 16 such as footwear is structured to conform to the body of the user. By way of example, when forming footwear, the toe cage of the shoe may be permitted to flex fully, increasing the fit across the toes which, in turn, increases the comfort of the wearer. Additionally, the auxetic layer 20, while permitting full expansion of the base layer 22 (e.g., expansion along two axes), still provides a supportive, semi-rigid framework that surrounds and supports the foot within the upper. An upper formed of the base layer material without the auxetic structure may be flimsy, lacking proper fit and a support structure sufficient to withstand the rigors of athletic activity.

The above described structure can provide apparel—garments, footwear, etc.—with a customized fit. The apparel will contour to the body while permitting stretch that matches body movement. For example, footwear is adapted to provide biomechanically correct levels of stretch as the foot moves. For example, the lateral and medial areas of the vamp (upper covering the midfoot) may include an auxetic arrangement with a four-way stretch base layer that, as a user walks, adjusts to movement. Specifically, the sides of the shoe will stretch to maintain contact with the foot while avoiding bunching of the upper material, thereby increasing user comfort. Additionally, since the auxetic upper moves with the user, the risk of friction injuries (blisters, etc.) is significantly lowered.

Figure 19:
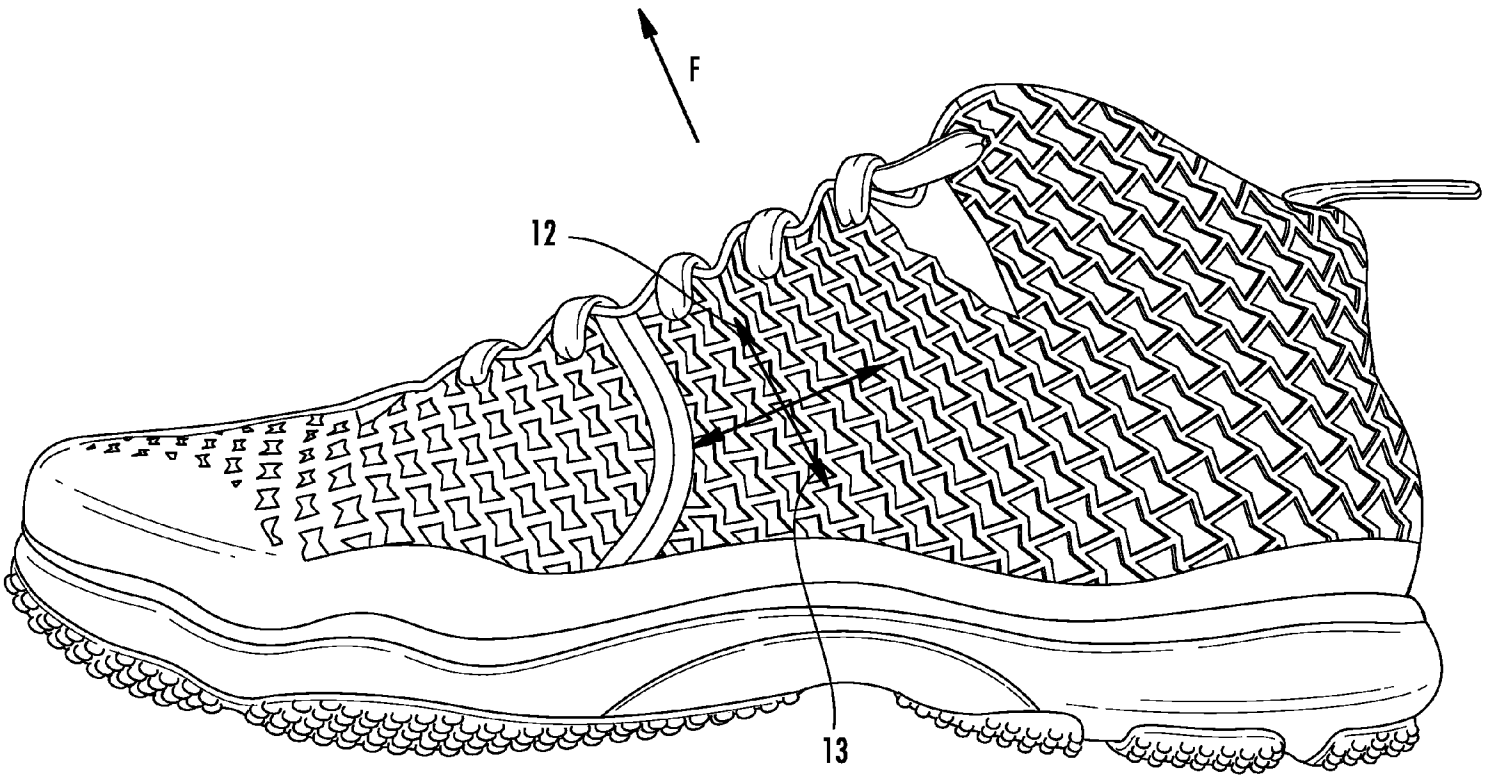
FIG. 19 illustrates a side view of an article of footwear including an auxetic arrangement, showing the operation of the arrangement.

Furthermore, the areas of the upper (the vamp) coextensive with the lacing system may be configured to expand auxetically as the user pulls on the laces and secures shoe to the foot. The force generated by the lacing system (indicated by arrow F), applies tension to the upper and, in particular, to the auxetic arrangement in the primary 12 direction. Accordingly, the upper will expand not only in the primary direction 12, but also in the secondary direction 13 due to the auxetic arrangement 14. See FIG. 19. Additionally, the auxetic arrangement 14 contours the upper to the double curvatures of the foot, thereby providing a more comfortable fit.

By way of further example, the heel area of the shoe may be formed of two way stretch material that permits significant horizontal expansion along the lateral sides of the heel, but limits the vertical expansion up the heel (or vice versa).

The foregoing detailed description of one or more exemplary embodiments of the articles of apparel including auxetic materials has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. An article of apparel comprising:

at least one panel including a first edge and an opposing second edge, the at least one panel including an auxetic structure defining a primary elongation direction and a secondary elongation direction; and a plurality of lace couplings positioned along the first edge and the second edge of the at least one panel, the plurality of lace couplings including a plurality of lace coupling pairs, each lace coupling pair including two adjacent lace couplings both positioned along either the first edge or the second edge of the at least one panel, each lace coupling pair defining a lace pull direction that is perpendicular to a line extending through the two adjacent lace couplings of the lace coupling pair, each lace pull direction substantially in alignment with either the primary elongation direction or the secondary elongation direction of the auxetic structure between the two adjacent lace couplings of the lace coupling pair.

2. The article of apparel of claim 1 further comprising at least one lace engaging the plurality of lace couplings, the at least one lace including a lace end, the at least one lace configured such that a force pulling on the lace end in a direction away from the plurality of lace couplings draws the lace couplings positioned along the first edge closer to the lace couplings positioned along the second edge.

3. The article of apparel of claim 1, the at least one panel including a base layer and an auxetic layer, the auxetic structure provided on the auxetic layer, and the auxetic layer coupled to the base layer.

4. The article of apparel of claim 3 wherein the base layer and the auxetic layer are integrally formed of a polymer material.

5. The article of apparel of claim 3 wherein the base layer is provided by a stretch fabric material.

6. The article of apparel of claim 5 wherein the stretch fabric material is a two-way stretch material.

7. The article of apparel of claim 6 wherein the two-way stretch material defines a direction of stretch, wherein the two-way stretch material is oriented with the direction of stretch substantially in alignment with the primary elongation direction of the auxetic structure in a first region of the article of apparel, and wherein the two-way stretch material is oriented with the direction of stretch substantially perpendicular to the primary elongation direction in a second region of the article of apparel.

8. The article of apparel of claim 1, the auxetic structure including a plurality of segments defining a repeating pattern of shapes with a void at a center of each shape.

9. The article of apparel of claim 8 wherein the void has an hourglass shape.

10. The article of apparel of claim 1 wherein the article of apparel is footwear, the first edge is a medial edge of a tongue opening, and the second edge is a lateral edge of the tongue opening.

11. The article of apparel of claim 10 wherein the footwear is a high-top shoe and the primary elongation direction of the auxetic structure is substantially different at a midfoot region of the high-top shoe than at an ankle region of the shoe.

12. A footwear article comprising:

a sole;

an upper coupled to the sole, the upper including a forefoot region, a midfoot region, and a heel region, the upper including a tongue opening defined between a medial edge and an opposing lateral edge in the midfoot region of the upper;

an integrally formed auxetic structure provided on a panel of the upper and extending from the forefoot region to the heel region, the integrally formed auxetic structure including a plurality of segments defining a repeating pattern of shapes with a void within each shape; and a plurality of lace couplings provided on the panel of the upper and extending along the medial edge and the lateral edge of the tongue opening.

13. The footwear article of claim 12, the auxetic structure defining a primary elongation direction and a secondary elongation direction, wherein the primary elongation direction of the auxetic structure is substantially different in the forefoot region than in the heel region.

14. The footwear article of claim 12 wherein the footwear article is a high-top shoe such that the upper includes an ankle region and the integrally formed auxetic structure further extends to the ankle region.

15. The footwear article of claim 12 wherein the void has an hourglass shape.

16. A footwear article comprising:

a sole; and an upper connected to the sole, the upper including a forefoot region, a midfoot region, and a heel region, the upper including at least one panel provided in the midfoot region, the at least one panel including a base layer connected to an auxetic layer, the base layer comprising a fabric stretch material and the auxetic layer comprising an auxetic structure defining a repeating pattern of voids.

17. The footwear article of claim 16, wherein the fabric stretch material is a two-way stretch fabric.

18. The footwear article of claim 16, the at least one panel defining a tongue opening between a first edge and an opposing second edge of the at least one panel, the footwear article further including a plurality of couplings positioned along the first edge and the second edge of the at least one panel, and the auxetic structure defining a primary elongation direction and a secondary elongation direction.

19. The footwear article of claim 18, the plurality of couplings including a plurality of lace coupling pairs, each lace coupling pair including two adjacent lace couplings both positioned along either the first edge or the second edge of the at least one panel, each lace coupling pair defining a lace pull direction that is perpendicular to a line extending through the two adjacent lace couplings of the lace coupling pair, each lace pull direction substantially in alignment with either the primary elongation direction or the secondary elongation direction of the auxetic structure.

20. The footwear article of claim 16 wherein the base layer is exposed through a first plurality of the repeating pattern of voids.

21. The footwear article of claim 20 wherein a second plurality of the repeating plurality of voids are filled with material.

22. The footwear article of claim 21 wherein the material is an elastic material.

23. The article of apparel of claim 1 wherein the auxetic structure includes a plurality of segments defining an array of cells, the array of cells including filled cells and unfilled cells.

24. The footwear article of claim 12 wherein a first plurality of voids in the repeating pattern of shapes are filled with material and a second plurality of voids in the repeating pattern of shapes are unfilled.

* * * * *